US009663336B2

(12) United States Patent
Roodenburg et al.

(10) Patent No.: US 9,663,336 B2
(45) Date of Patent: May 30, 2017

(54) CHAIN AND CABLE HANDLING WINCH SYSTEM AND A METHOD FOR CHANGING A CHAIN WHEEL

(71) Applicant: ITREC B.V., Schiedam (NL)

(72) Inventors: Joop Roodenburg, Delft (NL); Joost Sanderse, Nieuwerkerk Aan De Ijssel (NL); Gijsbert Schouten, Capelle Aan Den Ijssel (NL)

(73) Assignee: ITREC B.V., Schiedam (NL)

( * ) Notice: Subject to any disclaimer, the term of this patent is extended or adjusted under 35 U.S.C. 154(b) by 32 days.

(21) Appl. No.: 14/408,916

(22) PCT Filed: Jun. 18, 2013

(86) PCT No.: PCT/NL2013/000033
§ 371 (c)(1),
(2) Date: Dec. 17, 2014

(87) PCT Pub. No.: WO2013/191537
PCT Pub. Date: Dec. 27, 2013

(65) Prior Publication Data

US 2015/0321890 A1 Nov. 12, 2015

(30) Foreign Application Priority Data

Jun. 18, 2012 (NL) ..... 2009027

(51) Int. Cl.
*B66D 1/26* (2006.01)
*B66D 1/72* (2006.01)

(52) U.S. Cl.
CPC ..... *B66D 1/26* (2013.01); *B66D 1/72* (2013.01); *Y10T 29/49817* (2015.01)

(58) Field of Classification Search
CPC .... B66D 1/16; B66D 1/26; B66D 1/72; Y10T 29/49817

(Continued)

(56) References Cited

U.S. PATENT DOCUMENTS 594,722 A * 11/1897 Bodley ..... A61G 19/00 212/169
677,247 A * 6/1901 Meissner ..... A01B 3/66 104/169

(Continued)

FOREIGN PATENT DOCUMENTS

WO WO 2009/131463 A1 10/2009
WO WO 2011/139156 A1 11/2011

OTHER PUBLICATIONS

MacGregor, "Chain Wheel Manipulator", XP055082893, Apr. 11, 2013, pp. 1-2.

(Continued)

*Primary Examiner* — Emmanuel M Marcelo
*Assistant Examiner* — Michael Gallion
(74) *Attorney, Agent, or Firm* — Birch, Stewart, Kolasch & Birch, LLP

(57) ABSTRACT

A chain and cable handling winch system including a winch, a cable drum, a chain wheel, and a chain wheel lock assembly is provided. The chain wheel lock assembly releasable secures the chain wheel in a working position on a winch axle end. An interface body is mounted on the winch axle end such that it rotates with the axle. When the chain wheel is in its working position, slots and/or ribs of the chain wheel interlock with corresponding ribs and/or slots of the interface body, such that a torque load is transferred from the chain wheel to the winch axle via the interface body. The winch system further includes a chain wheel manipulator adapted to the exchange chain wheel mounted on the winch axle for another chain wheel.

15 Claims, 9 Drawing Sheets

(58) Field of Classification Search
USPC ..... 254/279, 365, 358
See application file for complete search history.

(56) References Cited

U.S. PATENT DOCUMENTS 700,319 A * 5/1902 Fowler ..... A61G 19/00 254/279
2,448,855 A * 9/1948 Black ..... B66D 5/026 188/296
2,464,907 A * 3/1949 Unruh ..... B66D 1/16 192/66.23
2,495,425 A * 1/1950 Schultz ..... B65H 54/54 242/390.7
2,705,126 A * 3/1955 Addicks ..... B66D 1/26 254/276
2,922,624 A * 1/1960 Addicks ..... B66D 1/16 192/101
3,606,257 A * 9/1971 Wilson ..... E21B 19/09 242/397.2
3,614,066 A * 10/1971 Day ..... B66D 1/16 212/84
3,645,519 A * 2/1972 Schwarz ..... C21C 5/462 187/348
3,738,614 A * 6/1973 Peterson ..... B66D 1/20 192/17 R
3,744,760 A * 7/1973 Uher ..... B66D 1/72 192/12 B
3,801,071 A * 4/1974 Barron ..... B63B 21/56 114/254
3,834,673 A * 9/1974 Alexander ..... B66D 1/741 192/14
4,023,775 A * 5/1977 Beattie ..... B66D 1/36 114/254
4,088,306 A * 5/1978 Falkner ..... B66D 1/20 254/350
4,274,620 A * 6/1981 Uher ..... B66D 1/72 192/94
4,434,971 A * 3/1984 Cordrey ..... E21B 19/08 173/11
4,504,249 A * 3/1985 Fortier ..... F16H 55/566 403/358
4,603,839 A * 8/1986 Ekman ..... B66D 1/7415 254/329
5,076,544 A * 12/1991 Mueller ..... B66D 1/30 254/266
5,123,630 A * 6/1992 Watson ..... B66D 1/24 254/346
5,871,069 A * 2/1999 Carmitchel ..... B66F 9/08 187/231
5,984,586 A * 11/1999 Wudtke ..... B63B 21/16 114/293
6,305,515 B1 * 10/2001 Heidenreich ..... F16D 25/0638 192/103 F
6,895,646 B1 * 5/2005 Houg ..... B25B 27/026 29/252
7,556,240 B1 * 7/2009 Bauer ..... B66D 1/14 254/294
7,891,641 B1 * 2/2011 Miller ..... B66D 1/16 254/344
7,900,894 B2 * 3/2011 Copp ..... B66D 1/16 254/348
8,079,569 B2 * 12/2011 Lesko ..... B66D 1/22 254/344
8,517,347 B2 * 8/2013 Forster ..... B63B 21/16 254/317
8,533,923 B2 * 9/2013 Strand ..... B63B 21/16 29/402.03
9,090,439 B2 * 7/2015 Tjensvoll ..... B66D 1/20
9,359,045 B2 * 6/2016 Nam ..... B66D 1/14
9,463,963 B2 * 10/2016 Hey ..... B66C 23/52
2005/0161655 A1 * 7/2005 Copp ..... B66D 1/16 254/346
2009/0101877 A1 * 4/2009 Zaguroli, Jr. ..... B66D 3/18 254/267
2011/0047773 A1 * 3/2011 Strand ..... B63B 21/16 29/402.08
2012/0305693 A1 * 12/2012 Takenoshita ..... G11B 23/044 242/340

OTHER PUBLICATIONS

The Motorship, "Offshore operators' needs met by innovations and upgrades", XP055082896, Nov. 30, 2011, pp. 1-2.

* cited by examiner

CHAIN AND CABLE HANDLING WINCH SYSTEM AND A METHOD FOR CHANGING A CHAIN WHEEL

On off shore vessel winches are used for handling wires. In addition, winches are often provided with chain wheels for handling chains, for example anchor chains. These chain and cable handling winches are provided with a cable drum for handling a wire and a chain wheel for handling a chain. The chain wheels are mounted on an end of the winch axle that carries the cable drum. The chain wheels are preferably mounted such that they can be replaced or changed. Chain wheels are subjected to considerable wear and must thus be replaced form time to time or brought to a workshop for repair. By changing a chain wheel for a chain wheel of different dimensions the winch can be used to handle chains of different dimensions.

Chain wheels are bulky and heavy. Replacing or changing a chain wheel thus requires the use of heavy lifting equipment. Since the space on offshore vessels is limited, and due to the size and weight of the chain wheels, handling a chain wheel, more in particular removing a chain wheel from or mounting a chain wheel on a winch axle is a dangerous undertaking. Therefore, removing and fitting is preferably done on shore, which requires removing the entire winch from the off shore vessel, or with quiet seas only. This is unwanted since a delay to change a chain wheel entails considerable costs.

A further draw back of the conventional winch systems provided with interchangeable chain wheels is that the chain wheels often get stuck on the axle. In conventional winch systems, the winch axle is provided with a hexagon shaped end for receiving a chain wheel. The chain wheel is provided with a central opening for engaging the end of the winch axle. The central opening is hexagon shaped such that it formfits the shape of the axle end. Thus, the chain wheel can be moved in an axial direction along the winch axle end for mounting and dismounting the chain wheel. The complementary shapes of the chain wheel opening and the winch axle end allow for transferring the torque load from the chain wheel to the winch axle and visa versa. A problem with these types of chain and cable handling winches is that the chain wheel often gets friction locked, i.e. gets stuck, on the axle. This further complicates replacing or changing a chain wheel, and is unwanted because an interruption to change a chain wheel entails considerable costs. Furthermore, wear on the axle and chain wheel is increased and the axle end and chain wheel may even get seriously damaged.

From WO2009/131463 a method and device for changing a chain wheel are known. For removing the chain wheel from the winch axis a hydraulic cylinder is fixed in a bore in the end of the winch axle. The cylinder is used for moving the chain wheel. When the chain wheel is removed from the axle it is connected to a conveying device for transporting the chain wheel.

The system requires an axial bore in the winch axle for fixing a hydraulic cylinder. Therefore, the system is not suited for retrofitting on existing winches. Furthermore, the cylinder or at least the hydraulic lines for actuating the cylinder are to be removed to allow the winch to be rotated, which makes removing and fitting a chain wheel complicated.

It is an object of the invention to provide an alternative chain and cable handling winch system and to preferably obviate or reduce one or more of the problems described hereinabove.

According to a first aspect of the present invention, the above mentioned object is achieved by designing a chain and cable handling winch system according to claim 1.

A chain and cable handling winch system according to a first aspect of the invention comprises a winch, a chain wheel, a chain wheel lock assembly, and an interface body. The winch comprises a winch axle, the axle having an end adapted to mount a chain wheel thereon in a working position, a cable drum mounted on the winch axle, a frame, supporting the winch axle such that the axle is supported on opposite sides of the cable drum by a first and second support, the first support being located inbetween the cable drum and the chain wheel end, more in particular the chain wheel end of the winch axle, and a motor drive adapted to drive the winch.

The cable drum is mounted on the winch axle, and the chain wheel is mounted in a working position on the winch axle at an end thereof, i.e. the chain wheel end of the winch axle. The frame supports the winch axle such that the axle is supported on opposite sides of the cable drum and inbetween the cable drum and the chain wheel.

The chain wheel has a chain wheel body with a central opening adapted to engage the chain wheel end of the winch axle. The chain wheel is in a working position when mounted on the winch axle end.

The chain wheel lock assembly is adapted to releasable secure the chain wheel in its working position on the winch axle end, more in particular the chain wheel end of the winch axle. The chain wheel lock assembly comprises one or more locking members movable between a locking position and an unlocking position.

According to the first aspect of the invention, the interface body is mounted on the winch axle such that it rotates with the winch axle. Furthermore, the interface body is provided with slots and/or ribs and the chain wheel is provided with corresponding ribs and/or slots. The slots and/or ribs of the interface body are adapted to cooperate with the corresponding ribs and/or slots of the chain wheel such that:

- when the chain wheel is mounted in its working position on the winch axle end the slots and/or ribs of the chain wheel interlock with the corresponding ribs and/or slots of the interface body, such that, when the chain wheel is subjected to a tangential force generating a torque load about the winch axle, this torque load is transferred from the chain wheel to the winch axle via the interface body and visa versa, and
- when the chain wheel is moved out of its working position in a direction substantially parallel to the winch axle, the slots and/or ribs and the chain wheel unlock with the corresponding ribs and/or slots of the interface body.

Thus, with a chain and cable handling winch according to a first aspect of the invention, the torque load is not transferred directly from winch axle to chain wheel and visa versa, but is transferred via the interface body. It is observed that this torque load can be depicted as a tangential vector, which lies in a plane perpendicular to the axis of rotation of the chain wheel.

Providing the chain wheel and the interface body with interlocking ribs and slots allows for a simple coupling system that is less prone to friction lock than is the case with known winch systems.

With known chain and cable handling winch systems, the chain wheel and the winch axle are typically directly coupled using formlock. The chain wheel is provided with a central opening complementary to the cross surface of the winch axle. For example both the opening and the winch axle have a hexagon shaped cross section such that when coupled the inner form of the opening formlocks with the outer form of the chain wheel axle. However, with such an a direct coupling between chain wheel and winch axle, the contact surfaces of the respective chain wheel and winch axle via which a torque load is transferred form one to the other are located close to the rotational axis of the chain wheel axle. Thus, the forces enacted on these surfaces when a torque is transferred are high. Chain wheels thus often get stuck on the axle ends.

Furthermore, the hexagon shape of the axle end leads to the transferred torque resulting in radial forces, which will further increase the risk of the chain will getting stuck on the axle end The use of an interface body according to the invention also allows for positioning the ribs and slots at a radial distance from the central axis of the winch axle, compared to a chain wheel having a central opening that is directly coupled to the winch axle. Thus, the pressure exerted on the contact surfaces of the ribs and slots are small and more evenly distributed compared to the pressures in known winch systems. This reduces the risk of the chain wheel getting friction locked on the winch axle. It is noted that if friction lock would occur between the interface body and the winch axle, this would be a lesser problem compared to friction lock between chain wheel and winch axle since the chain wheel has to be replaced more often than an interface body. The latter only needs to be replaced when it is seriously damaged and/or worn out.

In an embodiment according to the first aspect of the invention, the interface body is releasable fixed to the winch axle, such that when the interface body, more in particular the ribs and/or slots of the interface body get damaged, only the interface body can be replaced and there is no need for replacing the winch shaft. This is beneficial since replacing a winch shaft is time consuming and difficult task especially since the winch drum has to be removed from the winch axle.

The chain and cable handling winch system according to the first aspect of the invention thus provides an alternative chain and cable handling winch system, that enables reliable and efficient handling of chains and wires, more in particular allows for reliable and efficient dismounting chain wheels mounted on a winch axle and reliable and efficient fitting a chain wheel on a winch axle.

In a further embodiment according to the first aspect of the invention, the ribs and/or slots are provided with contact surfaces that transfer the torque load between the chain wheel and the interface body, which contact surfaces extend in a substantially radial direction and substantially parallel to the winch axle, such that the contact surfaces extend essentially perpendicular to a tangential force generating the torque load to be transferred between the chain wheel and the interface body. By providing such contact surfaces, whole or at least the main part of the torque load is transferred from contact surface to contact surface with no or only small forces being generated parallel to the contact surface, which reduces the chances of friction lock occurring.

In an embodiment, the ribs and or grooves have a longitudinal shape, and their longitudinal axis extends in the radial direction. In a further embodiment, the ribs and grooves located on the chain wheel are provided on a side thereof, such that the central opening of the chain wheel is free or substantially free of the ribs and grooves. Providing the ribs and grooves interface on the side of the chain allows for transferring toque loads via contact surfaces provided at a large distance from the winch axis.

In an embodiment according to the invention, the interface body has a cylindrical shaped section that extends along the winch axle, and the chain wheel in its working position is mounted on an outside surface of that cylindrical shaped section of the interface body. Thus, the interface body extends along at least a major part of the winch axle end supporting the chain wheel, especially when the interface body is provided with a flange as well. A large contact surface allows for large contact surface for transferring load between the interface body and the winch axle. Thus, the chance of the interface body getting stuck on the winch axle end.

It is noted that the axle end on which the chain wheel is mounted is normally limited in length. This because chain and wire handling winches are often used on decks of off shore vessel, on which space is limited. Furthermore, since the chain wheel is mounted on an end of the winch axle, it is preferably located close to the frame support to prevent the axle from bending under the load of the chain wheel.

In a further embodiment, the cross section of the cylindrical section has an outside contour complementary to the inside contour of the central opening of the chain wheel. Thus, a reliable and a secure fit of the chain wheel on the interface body is provided.

In an embodiment according to a first aspect of the invention the interface body is provided with a flange, which flange forms a stop for positioning the chain wheel in its working position such that when the chain wheel is locked in its working position, it is positioned inbetween the flange and the chain wheel lock assembly. The chain wheel is thus adapted to engage the side of the chain wheel and thus allows for positioning the chain wheel.

In a further embodiment, slots on the interface body and/or the chain wheel are provided with a dead end for receiving an end of a corresponding rib, thus stopping a chain wheel being mounted onto the winch axle end in its working position.

In a further embodiment, the slots and/or ribs of the interface body are provided on the flange and extend in an essentially radial direction, and the corresponding ribs and/or slots of the chain wheel are provided on a side of the chain wheel, such that they interlock when the chain wheel is mounted in its working position. Thus, the contact surfaces along which the slots and ribs engage each other when a torque is transferred between chain wheel and winch axle, also extend in the radial direction. By providing contact surfaces at a larger radial distance the load exerted on a surface area for transferring a load can be reduced.

In an embodiment according to the invention, the interface body is coupled with the winch axle via splines, preferably in the form of pins inserted in longitudinal grooves provided in the outside surface of the winch axle and corresponding longitudinal grooves provided in the inside surface of the bore of the interface body. This allows for a reliable connection, with a large contact surface, that can be removed when the interface body needs to be replaced. In an alternative embodiment, the interface body and the winch axle are connected via formlock, the winch axle and the central opening of the chain wheel having a complementary hexagon shape, or via a pin in hole connection in which the holes and pins extend in a radial direction, by bolting the interface body on the winch axle end, etc.

In an embodiment according to the first aspect of the invention, the one or more, preferably three or more, locking members of the chain wheel lock assembly are latches that can be moved between a radially inward locking position and a radially outward unlocking position, and the interface body and/or the winch axle is provided with one or more openings, the one or more openings facing radially outward, for receiving part of the locking members when in their radially inward locking position. Slideably mounted locking members allows for a lock that can be easily locked and unlocked. When the locking members are in their locking position, they at least prevent movement of the chain wheel along the winch axle.

In a further embodiment, the locking members are latches or pins that in their locking position engage a circumferential groove on the winch axle or interface body. Thus, the lock does prevent movement of the chain wheel along the winch axle, but enables to the chain wheel to be positioned in any rotational position on the axle end.

It is noted that the interlocking slots and ribs of the chain wheel and interface body block rotational movement of the chain wheel about the winch axle. Thus, the chain wheel lock assembly only needs to block movement of the chain wheel in a direction along the winch axle.

In a further embodiment, the lock is formed as a flange body provided with slots and/or ribs that interlock with corresponding ribs and/or slots of the chain wheel, such that, when the chain wheel is subjected to a torque load this load is transferred via the interface body and the chain wheel lock assembly. The chain wheel lock assembly thus functions as an additional interface body.

In a further embodiment, the interface body is adapted to be releasable mounted on the outermost end of the winch axle, and thus to function as a locking member.

In a further embodiment, the one or more locking members of the chain wheel lock assembly are located on the chain wheel, more in particular or one side of the chain wheel, and the slots and/or ribs of the chain wheel for cooperating with the corresponding ribs and/or slots of the interface are provided on an opposite side of the chain wheel. By providing the locking members on the chain wheel, the locking member and the chain wheel are integrated. Thus the locking member is no longer a separate body that needs to be mounted on the winch axle after the chain wheel has been positioned. This reduces the number of steps, and thus time, needed for exchanging a chain wheel. Furthermore, the chain wheel lock assembly can also be used for locking the chain wheel in a storage position, for example on a cylinder body in a storage, which cylinder body is shaped similar to the winch axle end.

In an embodiment according to the first aspect of the invention, the chain wheel lock assembly is an essentially ring shaped body provided with locking members, preferably with locking members movable in a radial direction between an inward locking position and a radial outward unlocking position. Such a chain wheel lock assembly is easy to mount on a winch axle end or on a chain wheel.

In an embodiment according to the invention, means are provided to block the locking members in their locking position. For example bolts, pins, latches, etc can be used to block the locking members in their locking position In a further embodiment, one or more resilient elements are provided that force the locking members towards their locking position, for example in their radially inward locking position. Thus, a reliable locking system is provided.

The interface body is preferably manufactured out of steel. In an embodiment the interface body and the slots and ribs provided thereon are essentially a single body.

In an embodiment, the one or more locking members of the chain wheel lock assembly are located on one side of the chain wheel, preferably are mounted on the chain wheel, and the slots and/or ribs of the chain wheel for cooperating with the corresponding ribs and/or slots of the interface body are provided on an opposite side of the chain wheel. Thus, the chain wheel lock assembly is easy accessible for locking and unlocking, and facilitates locking the chain wheel in a positioning in which it engages the interface body.

In a further embodiment, the chain wheel lock assembly is part of the chain wheel body. Thus, each chain wheel comprises its own lock assembly. Furthermore, lock assembly and chain wheel can be mounted on the axle end and dismounted from the axle end in a single step.

In an embodiment, the chain wheel lock assembly is an essentially ring shaped body provided with locking members, preferably with locking members movable in a radial direction between an inward locking position and a radial outward unlocking position. Thus, the chain wheel lock assembly is configured as a single unit, which facilitates manipulating the chain wheel lock assembly, for example positioning the chain wheel lock assembly on the axle end or mounting the chain wheel lock assembly on a chain wheel body.

In an embodiment, one or more resilient elements are provided that force the locking members towards their locking position. Thus, a safe and simple locking system is provided. The chance of the locking members moving into their unlocking position by accident is reduced.

In an embodiment the interface body further comprises an adapter which is mounted on an end face of the winch axle and positions the interface body in its position on the winch axle end. Providing an adapter for securing the interface body on the axle end allows for providing an adapter that fits the particular end of a specific winch axle with a more standardized interface body. The same interface body can be combined with different adapters such that it can be fit to different winch axle end. Providing an interface body thus is for example beneficial when retrofitting the interface body on existing winch axle ends. In an alternative embodiment, the adapter and the interface body are integrated in a single unit.

In a further embodiment, the adapter is provided with one or more openings for receiving the locking members when in their locking position to secure the chain wheel lock assembly on the winch axle.

In a further embodiment, the adapter is configured to receive a chain wheel manipulator for mounting a chain wheel on the winch axle and for dismounting a chain wheel from the winch axle, and position the manipulator relative to the interface body. Thus, the adapter further facilitates exchanging the chain wheel mounted on the axle end with another chain wheel. Alternatively, the adapter can be part of the chain wheel manipulator and is configured to receive the winch axle end.

According to a second aspect of the present invention, the above mentioned object is achieved by designing a Chain and cable handling winch system according to claim 16 and a method according to claim 46.

According to a second aspect, the invention provides chain and cable handling winch system comprising a winch, a chain wheel, a chain wheel lock assembly, and a chain wheel manipulator.

The winch has a winch axle, a winch axle, the axle having an end adapted to mount a chain wheel thereon in a working position, a cable drum mounted on the winch axle, a chain wheel mounted in a working position on the winch axle at an end thereof, a frame, supporting the winch axle such that the winch axle is supported on opposite sides of the cable drum by a first and second support, the first support being located inbetween the cable drum and the chain wheel end of the winch axle, and a motor drive adapted to drive the winch.

The chain wheel has a chain wheel body with a central opening adapted to engage the chain wheel end of the winch axle, which chain wheel is in a working position when mounted on the winch axle end.

The chain wheel lock assembly is adapted to releasable secure the chain wheel in its working position on the winch axle end, more in particular the chain wheel end of the winch axle. The chain wheel lock assembly comprises one or more locking members movable between a locking position and an unlocking position.

The chain wheel manipulator is adapted to the exchange chain wheel mounted on the winch axle end for another chain wheel. The chain wheel manipulator has a chain wheel support adapted to support a chain wheel, which chain wheel support can be positioned in a chain wheel exchange position adjacent to the winch axle end to mount a chain wheel onto the winch axle end and to dismount the chain wheel from the winch axle end.

The chain and cable handling winch system according to the second aspect of the invention thus provides an alternative chain and cable handling winch system, that enables reliable and efficient handling of chains and wires, more in particular allows for reliable and efficient dismounting chain wheels mounted on a winch axle and reliable and efficient fitting a chain wheel on a winch axle. The system is furthermore suited for handling chain wheels in severe off shore conditions, especially when used in combination with the first aspect of the invention, since the system allows for controlled and reliable removing of chain wheels form axle ends. This is even more the case when used with combined gripper/keys and/or a chain wheel lock assembly mounted on a chain wheel, as will be explained in more detail.

In a further embodiment, the chain wheel manipulator further comprises one or more grippers adapted to engage a chain wheel, and an actuator. The actuator is adapted to, when the chain wheel support is in its exchange position, move the grippers, in a direction substantially parallel to the winch axle between a couple position and a support position, and thus moving the chain wheel engaged by said grippers between its working position on the winch axle end and a transport position on the chain wheel support of the chain wheel manipulator. Thus, the invention provides a chain wheel manipulator adapted to more reliable and more safely move a chain wheel between a winch axle end and a chain wheel support positioned in a chain wheel exchange position.

In a further embodiment according to the second aspect of the invention, the chain wheel support comprises a cylindrical support body having a cross section that is essentially similar to the cross section of the central opening of a chain wheel. Thus a secure fit of the chain wheel onto the chain wheel support is provided.

In an embodiment, the winch axle, or an interface body provided thereon, is provided with an adapter for receiving the chain wheel manipulator, preferably for receiving an end of the chain wheel support of the chain wheel manipulator, to position the chain wheel support in its chain wheel exchange position. Providing such an adapter facilitates positioning the chain wheel manipulator in a position relative to the winch axle that enables moving the chain wheel between a transport position on the chain wheel manipulator and apposition on the winch axle.

In an embodiment, the adapter can be provided with a recess, for example a cone shaped recess, for receiving the end of the chain wheel support, for example a cone shaped end of the chain wheel support. In an alternative embodiment, the adapter is C-shaped adapter for receiving an end of a chain wheel support of a pivotably mounted manipulator. In a further embodiment, the chain wheel support of the chain wheel manipulator is at its end provided with a C-shaped section for receiving an end of the axle, such that it is partially supported by that axle end when the chain wheel is slid from the winch axle onto the chain wheel support or visa versa. This is especially beneficial when the chain wheel manipulator is coupled with the winch axle by pivoting the chain wheel manipulator, using for example a pivotably mounted carrier frame, in position.

In an embodiment, the actuator is adapted to slide the chain wheel engaged by the grippers from the winch axle end onto the chain wheel support and visa versa by moving the grippers between the couple position and the support position. By sliding the chain wheel from the winch axle onto the chain wheel support and visa versa, a reliable transfer is obtained. The chain wheel need not be lifted by the grippers, and in principle is continuously supported during the transfer. To enable optimal transfer by sliding, the cross section of the chain wheel support is substantially the same as the cross section of the winch axle end for supporting the chain wheel, and the both are positioned essentially in line with each other, the ends of the chain wheel support and the winch axle being positioned adjacent to each other. In a further embodiment, the end of the winch axle and the chain wheel support are shaped for engaging each other, such that both are coupled when the chain wheel is moved form one to the other, which benefits a smooth transfer form the one supporting surface to the other supporting surface.

In an embodiment, the grippers are adapted to secure the chain wheel in its transport position on the chain wheel support. The grippers retain the chain wheel in its transport position and thus prevent it from sliding from the chain wheel support. In an alternative embodiment, separate retaining means can be provided, which engage the chain wheel after it has been moved onto the chain wheel support. In another embodiment, additional retaining means can be provided for securing the chain wheel in its transport position in addition to the grippers securing the chain wheel. Retaining means for example are hooks or claws adapted to engage a chain wheel, for example the edge of a chain wheel.

In an embodiment, the grippers are supported by a gripper support frame, which gripper support frame is movable supported. Thus the grippers are positioned relative to each other by the frame, and an actuator can move all grippers by moving the support frame.

In a further embodiment, the gripper frame is movably mounted on the chain wheel support, such that it can slide along the chain wheel support.

In a further embodiment the gripper frame is pivotably mounted, for example pivotably mounted on a cylindrical shaped chain wheel support, such that when the chain wheel support is in its exchange position, the gripper frame can be rotated about an axle in line with the winch axle. Thus, the grippers can be positioned relative to the chain wheel prior to engaging the chain wheel, and for positioning the chain wheel relative to the winch axle when engaging the chain wheel, preferably while the chain wheel is supported by the chain wheel support.

In an embodiment, the one or more, preferably three or more, locking members of the chain wheel lock assembly can be moved between a radially inward locking position and a radially outward unlocking position. Thus, the locking members are moved in a plane perpendicular to the winch axle, which allows for a compact configuration of the chain wheel lock assembly with respect to the length of the winch axle. It is noted that axle ends for receiving the chain wheels are typically limited in length. A mounted chain wheel takes up most of this length of the winch axle end. By providing locking members that are moved in the radial direction, a chain wheel lock assembly which physically and in use takes up limited space with respect to the length of the winch axle is provided.

In a further embodiment, one or more resilient elements are provided that force the locking members towards their locking position, for example in their radially inward locking position. Thus, a reliable locking system is provided. The locking members are preferably manufactured out of steel. In an embodiment the locking members are latches that slide in the radial direction between a locking position and an unlocking position.

In an embodiment, the one or more, preferably three or more, locking members of the chain wheel lock assembly, when in their locking position, each engage a locking opening provided in the winch axle and/or in an interface body provided on the winch axle, the one or more locking openings facing radially outward. By providing openings for receiving the locking members on the outside surface of the winch axle and/or an interface body provided thereon, the chain wheel lock assembly can be mounted on the winch axle, and does not need to extend beyond the frontal surface of the winch axle. This allows for a compact configuration which is advantageously since the working space next to the winch axle a winch is often limited. A chain wheel lock assembly extending into this space might hamper working activities and/or positioning of the chain wheel support in the chain wheel exchange position. In an alternative embodiment, the chain wheel lock assembly engages openings in the frontal end surface of the winch axle, or an interface body provided thereon. Thus, the winch axle surface can be fully used for supporting the chain wheel.

In a further embodiment, the locking opening for receiving the locking members when in their locking position is a single circumferential groove, and the chain wheel lock assembly only limits movement of the chain wheel in a direction along the winch axle. Thus, the lock does prevent movement of the chain wheel along the winch axle, but enables to the chain wheel to be positioned in any rotational position on the axle end.

In an embodiment, the chain wheel lock assembly is an essentially ring shaped body provided with locking members, preferably with locking members slideable in a radial direction between an inward locking position and a radial outward unlocking position In an embodiment according to the first aspect of the invention, the chain wheel lock assembly is an essentially ring shaped body provided with locking members, preferably with locking members movable in a radial direction between an inward locking position and a radial outward unlocking position. Thus, the chain wheel lock assembly is configured as a single unit, which facilitates manipulating the chain wheel lock assembly, for example positioning the chain wheel lock assembly on the axle end or mounting the chain wheel lock assembly on a chain wheel body.

In a further embodiment, the chain wheel lock assembly is part of, or mounted on, the chain wheel body. Thus, each chain wheel comprises its own lock assembly. Furthermore, lock assembly and chain wheel can be mounted on the axle end and dismounted from the axle end in a single step.

In an embodiment, the manipulator comprises one or more keys, preferably one key for each locking member, adapted to engage the locking members of the chain wheel lock assembly and moving these locking members between their locking position and their unlocking position. Thus, the chain wheel manipulator can be used to unlock the chain wheel lock assembly, and no additional personnel is needed to do this.

In an embodiment, the chain wheel manipulator is configured to move the locking members when the chain wheel support is in its chain wheel exchange position. Thus, the chain wheel is only unlocked after the chain wheel manipulator, more in particular the chain wheel support of the chain wheel manipulator, is in place for receiving the chain wheel. Thus the risk of the chain wheel falling from the winch axle is further minimized.

In a further embodiment, the manipulator comprises one or more keys for engaging the locking members of the chain wheel lock assembly and moving the locking members between a radially inward locking position and a radially outward unlocking position. In a further embodiment, the keys are adapted to interlock with the locking members. In addition, the keys and locking members are configured such that the keys can only engage and disengage the locking members when in their locking position, and can not disengage the locking members when they have moved the locking members out of their locking position. In such an embodiment, the chain wheel manipulator can only engage and disengage a chain wheel when the locking members are positioned in their locking position. Thus it is prevented that a chain wheel is incorrectly mounted on for example a winch axle end, more in particular is mounted without the chain wheel lock assembly securing the chain wheel in its position on the axle end.

In an embodiment the grippers are adapted to function as keys for moving the locking members between their locking position and their unlocking position. The keys are adapted to interlock with the locking members and/or the chain wheel, preferably by moving the locking members out of their locking position. Thus, the keys can be used to move, preferably slide, the chain wheel between its working position and its transport position when the locking members are moved out of their locking position.

Integrating the function of the grippers and the keys allows for quick and easy unlocking and removing a chain wheel.

In an embodiment, the chain and cable handling winch system comprises a carrier frame that supports the chain wheel manipulator. In a further embodiment, the carrier frame rotatably supports the chain wheel manipulator such that the chain wheel angular position of the chain wheel manipulator can be adjusted for engaging a chain wheel or the angular position of a chain wheel supported by the chain wheel manipulator can be adjusted to enable mounting the chain wheel on a winch axle.

In an embodiment, the chain wheel manipulator is rotatable about a longitudinal axis of the chain wheel support, i.e. about the pivot axis of the winch when the chain wheel support is mounted in its chain wheel exchange position, In an alternative embodiment only part of the chain wheel manipulator is rotatable, for example the gripper support frame is rotatably mounted on the chain wheel support, and the chain wheel support itself is not rotatably supported by the carrier frame.

In a further embodiment, the carrier frame is adapted to be transported, such that the chain wheel manipulator, more in particular its chain wheel support, can be moved between at least the exchange position adjacent the winch axle and a chain wheel storage. Thus, the chain wheel manipulator can be used for storing chain wheels in a storage, in addition to mounting and dismounting chain wheels from axle ends, more in particular winch axles. In an embodiment, the carrier is for example adapted to be engaged by a crane or a robot arm. In a further embodiment, the carrier frame is provided with for example wheels or skids or is movably supported on a transport track for guiding the carrier frame.

In an alternative embodiment, the chain and cable handling winch system further comprises a carriage frame that supports said carrier frame. In a further embodiment, the carrier frame pivotably supports said carrier frame such that the chain wheel support can be pivoted between a first position for mounting and dismounting a chain wheel at a first side of the frame and a second position for mounting and dismounting a chain wheel at an opposite side of the frame. In an embodiment, the carriage frame is adapted to be transported as described above.

In a further embodiment, the chain and winch handling winch system further comprises a transport frame adapted to movably support the carriage frame. In an embodiment, the transport frame is adapted to be transported as described above, and is for example movable along a transport track for example is movably supported by a transport track.

In a further embodiment, the carrier frame or the carriage frame supporting the carrier frame is movably mounted in the transport frame such that it can be moved in for example a vertical direction for lifting and lowering the chain wheel manipulator, preferably for lifting and lowering the manipulator between a below deck position and an above deck position. Thus, the chain wheel manipulator can be lifted and lowered, and can for example be moved between different storage positions.

In a further embodiment, the chain and cable handling winch system further comprises a support frame adapted to movably support the carriage frame and the carriage frame and the transport frame are configured such that the carriage frame can be transfer between the transport frame and the support frame. With such an embodiment it is for example possible to mount the support frame on deck and the transport frame below deck. Thus, the carrier frame can for example be transferred between a chain wheel exchange position in a support frame adjacent a chain and cable handling winch and a storage below the chain and cable winch.

Furthermore, when the storage is provided below deck, the chain wheels, and preferably the chain wheel manipulator, can be stored below deck, which frees up deck space.

Furthermore, chain wheels and chain wheel manipulator are thus protected from the environment, for example rainstorms, etc.

In an embodiment, the chain wheel storage is provided below the chain and cable handling winch, preferably the winch is mounted on the deck of a vessel and the chain wheel storage is located below deck.

By providing a transport frame and a separate, deck mounted, support frame the chain wheel manipulator can safely and securely be lifted from a below deck position to an above deck position, without the need of a single, and thus large and heavy transport frame for moving the chain wheel manipulator between decks and along a storage track.

In a further embodiment, the chain wheel storage is provided with axle ends for each supporting a chain wheel in a storage position. Thus the chain wheel lock assembly for securing a chain wheel in its working position on an axle end can be used for securing the chain wheel in its storage position also.

In an embodiment, the chain wheel manipulator is pivotably supported in a frame, for example the carrier frame, such that it can be pivoted, preferably about a central pivot axis, for moving a chain wheel from one a side of the frame to an opposite side of the frame and visa versa and/or between an exchange position for mounting and dismounting a chain wheel at a first side of the frame and an exchange position for mounting and dismounting a chain wheel at an opposite side of the frame. Thus, the chain wheel manipulator can be used with two winches without moving the frame. This is for example beneficial when the storage is provided with storage positions on both sides of the transport track, or when the carrier frame is received in an above deck support frame located between two chain wheel winches of which the axle ends are directed to opposite sides of the frame.

For example, in an embodiment a chain wheel storage is provided with axle ends for each supporting a chain wheel on opposite sides of a transport track, and the carrier frame of the chain wheel manipulator is pivotably supported in a frame, for example a transport frame supported by the transport track. The chain wheel manipulator can thus be pivoted with its chain wheel support between chain wheel exchange position for the first and a chain wheel exchange position for the second chain and cable handling winch.

In another embodiment, the chain and cable handling winch system comprises a second cable and wire handling winch and both winches are mounted such that the ends of the respective chain axles for supporting a chain wheel face each other. The carrier frame supporting the chain wheel manipulator is pivotably supported in the carriage frame such that the chain wheel manipulator can be pivoted with its chain wheel support between a chain wheel exchange position for the first and a chain wheel exchange position for the second chain and cable handling winch.

In a further embodiment, the transport track covers multiple chain and cable handling winches such that the chain wheel manipulator, more in particular its chain wheel support, can be moved between multiple chain wheel exchange positions for changing chain wheels of different winches. Thus, one or a limited number of chain wheel manipulators can be used for serving multiple chain winches In an embodiment of a chain and cable handling winch according to the invention, the first aspect of the invention, more in particular an interface body according to the first aspect of the invention, is integrated with a chain and cable handling winch system according to the second aspect of the invention. Such a winch system is especially advantageously since an interface body according to the first aspect of the invention prevents a chain wheel from getting stuck on the winch axle. Since less force is needed to remove the chain wheel, it facilitates removing the chain wheel from the winch axle using a chain wheel manipulator. Also, the interface body according to the first aspect of the invention, can be specially adapted to function with the chain wheel lock assembly of the second aspect of the invention. Thus, by combining these aspects, the winch axle does not need to be adapted to be used with the chain wheel lock assembly. Combining these aspects is thus especially beneficial when retrofitting a winch system according to the second aspect of the invention with an existing winch.

It is observed that the invention is explained in combination with a winch, the winch being provided with a single winch drum. It should be understood that the invention, that is the first aspect as well as the second aspect, can be used with any type of chain winch, for example with a double drum traction winch.

It is observed that the first aspect of the invention can be advantageously combined with the second aspect of the invention, as is also shown in the figures, and the second aspect of the invention can be advantageously combined with the first aspect of the invention, as is also shown in the figures.

It is observed that the invention, that is the first aspect as well as the second aspect, thus provides alternative chain and cable handling winch systems, that enable reliable and efficient handling of chains and wires, more in particular allow for reliable and efficient dismounting chain wheels mounted on a winch axle and reliable and efficient fitting a chain wheel on a winch axle.

The invention furthermore provides a vessel, offshore platform or the like provided with a chain and cable handling winch system according the invention, i.e. according to the first and/or second aspect of the invention.

Advantageous embodiments of the chain and cable handling winch system according to the invention and the method according to the invention are disclosed in the subclaims and in the description, in which the invention is further illustrated and elucidated on the basis of a number of exemplary embodiments, of which some are shown in the schematic drawing.

BRIEF DESCRIPTION OF THE DRAWINGS

FIG. 1 shows a schematic drawing of a side view of a chain and cable handling winch system 1 according to the first aspect of the invention. The chain and cable handling winch system 1 comprises a winch axle 2, a cable drum 3 mounted on the winch axle 2, and a chain wheel 4 mounted in a working position on the winch axle 2 at an end thereof. The winch system further comprises a frame 5. The frame 5 rotatably supports the winch axle 2 such that the axle is supported on opposite sides of the cable drum 3 and inbetween the cable drum 3 and the chain wheel 4. The winch system also comprises a motor drive 38 adapted to drive the winch axle 2.

Figure 1:
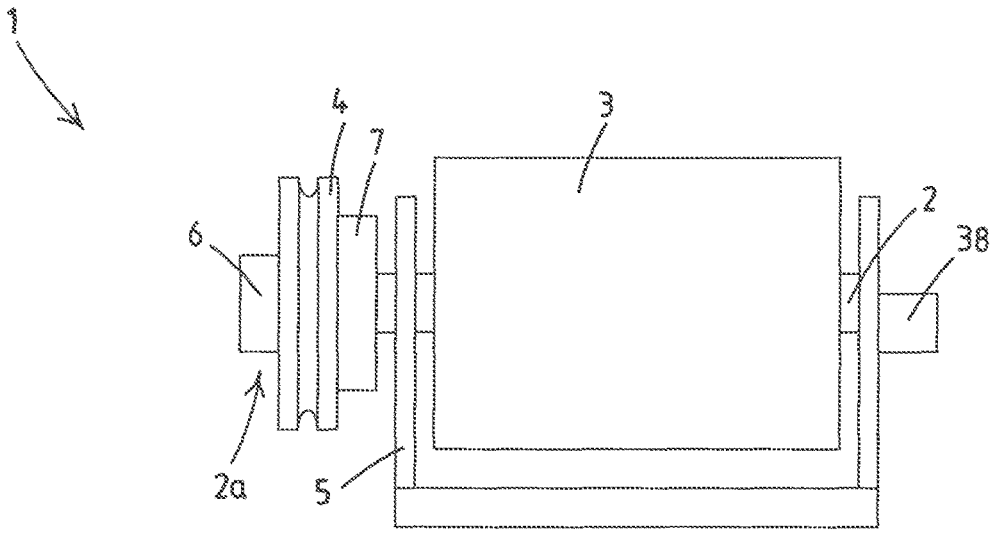
FIG. 1 shows a schematic side view of a first exemplary embodiment of a chain and cable handling winch system according to a first aspect of the invention.

It is noted that the drawing is simplified for explanatory purposes. It should be clear that the invention can be used with many types of chain and cable handling winches, for example cable and chain handling winches provided with multiple drives that engage the cable drum to rotate the cable drum and the winch axle, cable and chain handling winches with a chain wheel mounted at each end of the cable winch, etc.

The chain and cable handling winch system according to the first aspect of the invention shown furthermore comprises a chain wheel lock assembly 6, and an interface body 7. The chain wheel lock assembly 6 is adapted to releasable secure the chain wheel 4 in its working position on the winch axle end 2*a*.

The interface body 7 is mounted on the winch axle, more in particular on an end of the winch axle, such that it rotates with the winch axle. Thus, when an external force engages the interface body such that it generates a torque load that rotates the interface body, the winch axle is also rotated. When the winch axle is driven the interface body is driven and visa versa.

According to the first aspect of the invention, the interface body is provided with slots and/or ribs and the chain wheel is provided with corresponding ribs and/or slots, which slots and/or ribs of the interface body are adapted to cooperate with the corresponding ribs and/or slots of the chain wheel. The slants and ribs chain can be used to couple the chain wheel and the interface body and to transfer a torque load from the chain wheel to the interface body and visa versa. When coupled, the chain wheel and the interface body function as a single unit, i.e. when the interface body is driven the chain wheel is driven and visa versa.

Figure 2B:
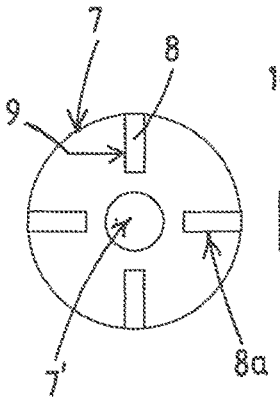
FIGS. 2A and 2B shows a schematic side view of the chain and cable handling winch system of FIG. 1 and a frontal view of its interface body.
Figure 2A:
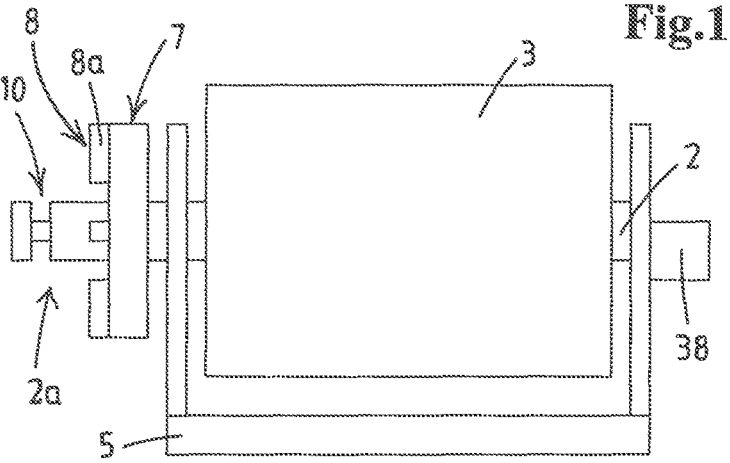

FIGS. 2A and 2B show the embodiment of FIG. 1 wherein the chain wheel lock assembly 6 and the chain wheel 4 have been removed, such that some of the ribs 8 provided on the interface body 7 are visible. In the embodiment shown, the interface body 7 is provided with four ribs 8, extending in a radial direction, and the chain wheel is provided with four corresponding slots for receiving these ribs. Furthermore, FIGS. 2A and 2B show a circumferential groove 10 provided on the winch axle for receiving locking members (not shown in the Fig.) from the chain wheel lock assembly.

According to the first aspect of the invention, the interface body is provided with slots and/or ribs and the chain wheel is provided with corresponding ribs and/or slots, which slots and/or ribs of the interface body are adapted to cooperate with the corresponding ribs and/or slots of the chain wheel. The slots and/or ribs of the interface body are adapted to cooperate with the corresponding ribs and/or slots of the chain wheel such that when the chain wheel 4 is mounted in its working position on the winch axle 2, the slots of the chain wheel interlock with the corresponding ribs 8 of the interface body 7. When the chain wheel 4 is subjected to a torque load about the winch axle 2, indicated with arrow 9 representing a tangential force generating said torque, this load is transferred to the interface body. The torque load is transferred via the contact surfaces of the ribs to the contact surfaces of the slots. The ribs and slots are preferably provided with contact surfaces having a large, preferably flat, surface area. Thus, the load to be transferred is divided over a large surface area and the risk of peak pressures, and thus of damage to the ribs and slots that might get the chain wheel stuck on the interface body, is reduced.

The arrow 9 illustrates that the force generating a torque about the winch axle is directed essentially perpendicular to the respective contact surfaces when these surfaces extend in a substantially radial direction. It is noted that in the fig. the torque load 9 is transferred from the chain wheel to the winch axle via the interface body, and the chain wheel thus drives the winch axle. In practice it is often the other way around, i.e. the winch axle is driven, either directly or via the cable winch. The torque generated by the drive is transferred from the winch axle to the chain wheel via the interface body.

Furthermore, the ribs and the corresponding slots cooperate such that when the chain wheel is moved out of its working position in a direction parallel to the winch axle, the slots of the chain wheel unlock with the corresponding ribs of the interface body. Thus, the chain wheel and the interface body can be coupled and uncoupled by simply sliding the chain wheel onto the winch axle or from the winch axle respectively. In the embodiment shown, this is achieved by ribs and slots extending parallel to the winch axle, in addition to extending in a radial direction. It is noted that this configuration is preferred since it provides ribs and slots with contact surfaces for transferring torque load that extent essentially parallel to the winch axle. However, other configurations are also possible. For example, the ribs shown in FIGS. 2A and 2B as longitudinal bodies that extend in the radial direction, can be replaced with a row of multiple pins or teeth, the rows extending in the radial direction.

Thus, the first aspect of the invention provides an interface body as an intermediate between the winch axle and the chain wheel. The chain wheel is not directly coupled to the winch axle, and a torque load is transferred between the chain wheel and the winch axle via the intermediate interface body.

The chain wheel and the interface body are coupled via interlocking ribs and slots, which allows for a simple coupling system that is less prone to friction lock than is the case with known winch systems. Furthermore, the ribs and slots are located at a large radial distance from the central axis of the winch axle in comparison with a chain wheel having a central opening that is directly coupled to the winch axle, for example is in formlock with a shaped winch axle.

With known chain and cable handling winch systems, the chain wheel is for example provided with a hexagon central opening for engaging the hexagon shaped end of a chain wheel axle such that the two can be coupled in formlock. However, with such an embodiment, the contact surfaces via which the torque load is transferred between chain wheel and winch axle are located at the circumference of the winch axle, and thus comparatively close to the rotational axis of the winch axle.

Thus, according to the invention, due to the increased distance between at least part of the contact surfaces and the axis of the winch axle, the pressure exerted on the contact surfaces of the ribs and slots according to the first aspect of the invention are comparatively small and are more evenly distributed. This reduces the risk of the chain wheel getting friction locked on the winch axle.

FIG. 2B shows a frontal view of the interface body 7 and the ribs 8 provided thereon. It is shown in the figure that the ribs 8 have contact surfaces 8*a* along their side for contacting contact surfaces along the sides of the corresponding slots in the chain wheel 4. The interface body has a central opening 7' for receiving the winch axle.

In the embodiment shown the interface body 7 is provided with a flange 7*a*, more in particular is a flange shaped body, which flange forms a stop for positioning the chain wheel 4 in its working position such that when the chain wheel is locked in its working position, it is positioned between the interface body 7 and the chain wheel lock assembly 6. In another embodiment, a stop can for example be provided in the form of a radial extension of the winch axle. By providing the ribs 8 on the flange shaped boy 7, and the ribs extending in an essentially radial direction, they provide additional stiffness to the interface body.

When the chain wheel is located in its working position, the contact surfaces of the ribs and slots of the interface body and the chain wheel respectively are located directly adjacent each other. A torque load is transferred between the chain wheel and the interface body via the contact surfaces.

It is noted that the ribs and slots of the chain wheel and interface body engage in formlock. The configuration of an interface body and a chain wheel according to the invention makes that this formlock causes less peak pressures, and the chain wheel is thus less likely to get stuck, than the formlock between chain wheel and winch axle as known from the prior art. It is furthermore noted that the interface body according to the invention is directly coupled with the winch axle. For this coupling form lock as known form the prior art can be used. The risk of the interface body getting stuck on the winch axle is acceptable since the interface body, in contrast with the chain wheel, does not need to be changed, or at least does not need to be changed as often as the chain wheel needs to be changed.

In the embodiment shown, the contact surfaces 8*a* of the interface body extend in a substantially radial direction and substantially parallel to the winch axle 2, such that the contact surfaces extend essentially perpendicular to a torque load, indicated with arrow 9, to be transferred between the chain wheel 4 and the interface body 7. By providing contact surfaces for transferring the torque load, which contact surface extend in a plane substantially perpendicular to the tangential force representing the torque load being transferred, the risk of the chain wheel and the interface body, more in particular the slots and/or ribs of the chain wheel and the corresponding ribs and/or slots of the interface body getting stuck on the interface body, is minimized.

Figure 3B:
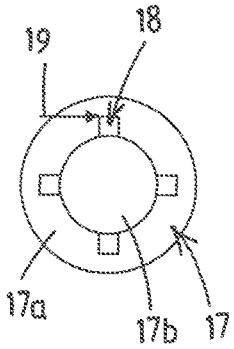
FIGS. 3A and 3B shows a schematic side view of a second exemplary embodiment of a chain and cable handling winch system according to a first aspect of the invention and a frontal view of its interface body.
Figure 3A:
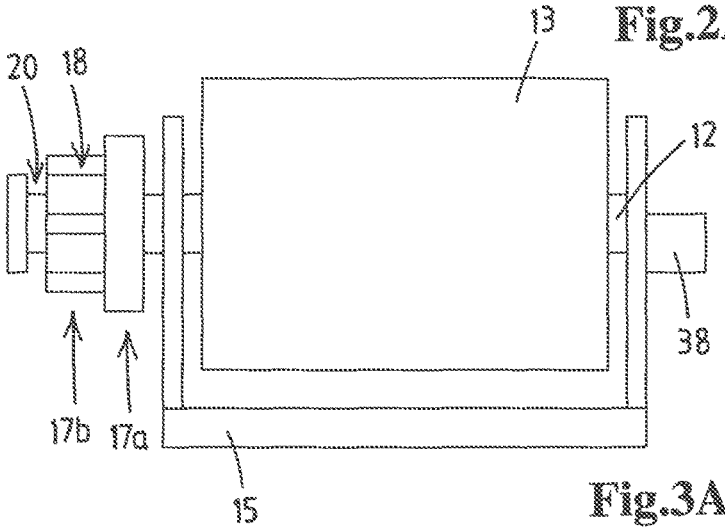

FIG. 3A shows a schematic drawing of a side view of an alternative embodiment of a chain and cable handling winch system 11 according to the first aspect of the invention. The chain and cable handling winch system 11 comprises a winch axle 12, a cable drum 13 mounted on the winch axle 12, and an interface body 17, which interface body is also shown in frontal view in FIG. 3B. The winch system further comprises a chain wheel mounted to be mounted in a working position on the winch axle at an end thereof with a chain wheel lock assembly as shown in FIG. 1 (both elements are not shown in FIGS. 3A and 3B). The winch system further comprises a frame 15 that rotatably supports the winch axle 2 such that the axle is supported on opposite sides of the cable drum 13 and inbetween the cable drum 13 and the chain wheel 14. The winch system also comprises a motor drive 38 adapted to drive the winch axle.

The chain and cable handling winch system 11 differs from the one shown in FIGS. 1 and 2 in the configuration of the interface body. Similar to the interface body 7 shown in FIGS. 1 and 2, the interface body 17 is provided with a flange 17*a*. However, the interface body 17 is furthermore provided with a cylindrical shaped section 17*b* that extends along the end 12*a* of the winch axle 12. When in its working position a chain wheel is located on this cylinder shaped section. A similar interface body 27, i.e. an interface body comprising a flange section and a cylinder shaped body section, is shown in perspective view in FIGS. 4-6. Providing the interface body with such a cylinder shaped body section allows for the interface body to receive the axle end of the winch axle. Thus, the contacts surface for transferring torque between interface body and winch axle can be larger than with the interface body consisting of just a flange section, as shown in FIG. 1. The cylinder section of the interface body thus allows for a more reliable attachment of the interface body on the winch axle. Furthermore, the cylindrical shaped body section of the interface body can be adapted for cooperation with a chain wheel lock assembly for securing a chain wheel in it position on the winch axle, as will be explained in more detail below.

It is observed that in an embodiment according to the invention, the interface body is provided with a central opening that fits the end of an existing winch axle. Thus, the interface body can for example be provided with a hexagon shaped central opening to fit a hexagon shaped winch axle end. Alternatively, the winch axle end can be adapted for receiving the interface body. The interface body can be rotationally fixed onto the winch axle end by way of formfit, by using pegs, by using blots, etc.

To facilitate retrofitting the chain and cable winch handling system according to the invention to a winch system already on the market, the interface body can be provided with the cylindrical part having an outside diameter similar to the outside diameter of the original axis to which it should be fitted. The original axis is reduced for fitting the cylindrical part thereon. Thus the central opening of a chain wheels used with the original winch axle also fit for mounting the wheel on the interface body. If the chain wheels have been fit to the original chain wheel axle by way of formlock, an insert can be provided that provided the chain wheels with a cylindrical shaped opening to fit the cylindrical shaped outside surface of the interface body.

In an alternative embodiment, the interface body is made to fit the winch axle, and the central opening of the chain wheels is adapted or new chain wheels are provided that fit the outside surface of the interface body. Such an interface body is shown in FIGS. 3A and 3B, wherein the outside circumference of the cylindrical body is substantially larger than the outside circumference of the winch axle.

In the embodiment shown in FIGS. 3A and 3B, the interface body is provided with ribs 18 that have a longitudinal axis that extends extend along the cylindrical shaped section. The ribs are provided on the outside surface of the interface body. Since the outer circumference of the cylindrical section of the interface body is larger than the outer circumference of the winch axle, the contact surfaces of these ribs are thus located at a distance to the winch axle that is larger than the distance of contact surface that are provided directly on the winch axle. Thus, peak pressures are reduced and the chance that the chain wheel gets stuck is minimized.

The cylindrical shaped section 17*b* is furthermore provided with a groove 20 extending along its circumference for receiving locking members of the chain wheel lock assembly, to lock the chain wheel lock assembly, and thus the chain wheel, in position. By providing the interface body with a cylindrical shaped section that receives the winch axle end, the groove for receiving the lock can be provided in the interface body, or a part thereof.

It is noted that preferably the interface body is made to fit the winch axle end, and adaptation of the winch axle end is prevented as much as possible, since the latter normally is more difficult. When the chain and cable handling winch system is retrofitted on an existing winch, the interface body is thus preferably provided with a cylindrical shaped section for receiving the axle end and adapted to cooperate with the chain wheel lock assembly.

Figure 6:
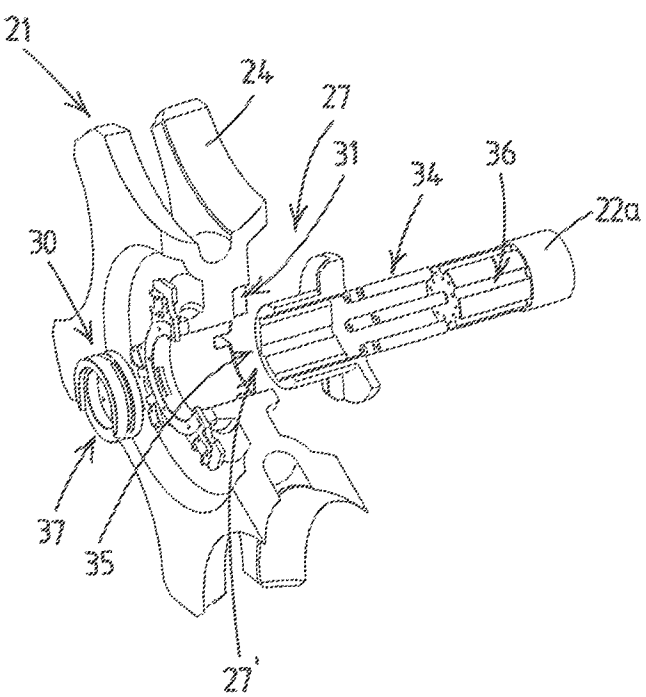
FIGS. 4-6 show a third embodiment of a chain and cable handling winch system according to a first aspect of the invention.
Figure 5:
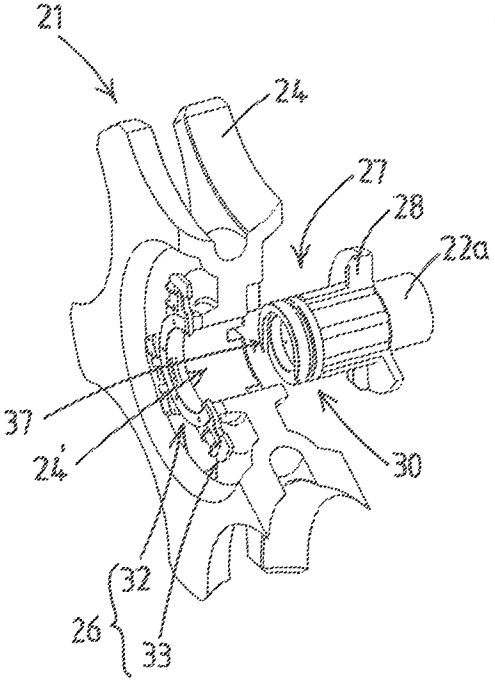
Figure 4:
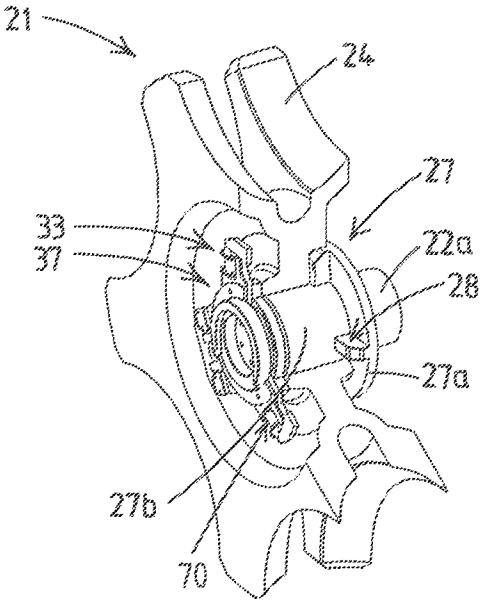

FIGS. 4-6 show part of a chain and cable handling winch system 21 according to the first aspect of the invention. The figures show a chain wheel 24, partially in cross section, the end of the winch axle 22*a*, and the interface body 27 provided thereon. The interface body 27 is shown partially in cross section in the FIGS. 5 and 6. FIG. 4 shows the chain wheel 24 mounted in working position on the interface body, FIG. 5 shows the chain wheel 24 removed from its working position, and FIG. 6 shows an exploded view of the assembly of interface body 27 and the winch axle end 22*a*.

The interface body 27 of the embodiment shown comprises a flange 27*a* and a cylindrical shaped section 27 *b* that, when the interface body is mounted on the winch axle, extends along the winch axle end 22*a*, as shown in FIGS. 4 and 5.

In the embodiment shown, the interface body 37 is coupled with the winch axle end 22*a* using splines 34. Both the interface body and the winch axle end are provided with grooves for receiving the splines 34. With the interface body, the grooves 35 are provided on the inside surface of the central opening 27' for receiving the axle end 22*a*. The axle end 22*a* is provided with grooves 36 in its outside surface. The grooves extend in the axial direction and along the length of the cylindrical body to create a large contact surface for transferring torque load between the interface body and the winch axle.

In an embodiment, the splines are fixed in position by using slightly oversized splines that are cooled to shrink just prior to installation, preferably in combination with heating the interface body to be placed over them. After installation, pins expand to their original size, and the interface body shrinks to its original size, thus securely clamping the interface body in its position. It is noted that as an alternative, other ways of fixing a body on an axle that are known in the art can also be used to fix the interface body on the winch axle.

The interface body is provided on its flange section with four ribs 28, extending in the radial direction. The ribs 28 corresponding with four slots 31, also extending in the radial direction, provided in the side of the chain wheel 24. The ribs and or grooves have a longitudinal shape, and their longitudinal axis extends in the radial direction. Furthermore, the grooves located on the chain wheel are provided on a side thereof, such that the central opening of the chain wheel is substantially free of grooves. Providing the ribs and grooves interface on the side of the chain wheel only allows for transferring toque loads with small as well as large chain wheels In the embodiment shown, the interface body furthermore comprises an adapter 37 for receiving a chain wheel manipulator that transports the chain wheel, as will be explained in more detail furtheron. The adapter 37 is provided with a C-shaped section for receiving a cylindrical shaped end of a chain wheel support of a chain wheel manipulator. The chain wheel support of such a chain wheel manipulator is preferably shaped such that when placed in line with the winch axle, the chain wheel can be slid from the winch axle, or the interface body provided thereon, onto the chain wheel support. The manipulator for exchanging and transporting chain wheels will be discussed in more detail further on in this text.

In the configuration shown, the chain wheel lock assembly 26 releasable secures the chain wheel 24 in its working position on the winch axle end 22*a*. In the embodiment shown, the chain wheel lock assembly is provided on the chain wheel. In an alternative embodiment, the chain wheel lock assembly can be configured as a separate body.

The chain wheel lock assembly 26 in the embodiment shown is configured as a ring shaped body 32 provided with three locking members 33 for in a locking position securing the chain wheel in its working position on the winch axle end, and in an unlocking position enabling the chain wheel to be moved from its working position.

The locking members 33 shown are movable in a radial direction between the locking position and the unlocking position. In the FIGS. 4-6, the locking members are depicted in their radially inward locking position. In this position, an end of the locking members extends into the central opening 24' of the chain wheel 24, as can be seen in FIGS. 5 and 6. These ends of the locking members preferably engage a groove provided on the winch axle, the interface body, or a part thereof. In the particular embodiment shown, the groove 30 for receiving the ends of the locking members 33 is provided on the adapter 37, which is part of the interface body 27.

In the embodiment shown, the locking members are provided with a circular opening for receiving an unlocking means, or keys, for moving the locking member between its locking position and its unlocking position. These unlocking means are preferably provided on a manipulator for exchanging the chain wheel, as will be discussed in more detail further on.

When the chain wheel 24 is being mounted on the winch axle end 22*a*, more in particular on the cylindrical shaped section 27*b* of the interface body mounted on the winch axle end 22*a*, the chain wheel is positioned with its central opening 24' concentric with the winch axle, as shown in FIG. 5.

The chain wheel 24 is subsequently moved, in a direction parallel to the winch axle axis, into its working position, which is shown in FIG. 4, in which it is coupled with the interface body 27. The chain wheel locking assembly is in its unlocking state while the chain wheel is moved into its working position.

Preferably, prior to sliding the chain wheel onto the winch axle, the chain wheel has already been positioned such that the slots 31 are in line with the ribs 28 of the chain wheel interface body. In an alternative method, the chain wheel is positioned with its slots in line with the ribs after the chain wheel has been, partially, positioned on the winch axle and/or interface body (depending on the configuration of the interface body) and prior to being positioned in its working position.

To position the chain wheel 24 in its working position, the slots of the chain wheel are moved over the ribs of the interface body to couple chain wheel and interface body. The now interlocking slots and ribs enable transfer of a torque load about the winch axle between the chain wheel and the interface body.

It is noted that in the embodiment shown, the ribs 28 and slots 31 are provided with contact surfaces that transfer the torque load between the chain wheel and the interface body, which contact surfaces extend in a substantially radial direction and substantially parallel to the winch axis, such that the contact surfaces extend essentially perpendicular to a tangential force representing the torque load to be transferred between the chain wheel and the interface body.

After the chain wheel 24 has been moved into its working position, the locking members 33 of the chain wheel lock assembly are moved from their unlocking position into their locking position, to secure the chain wheel in its working position. The chain wheel is now ready for use.

Figure 7:
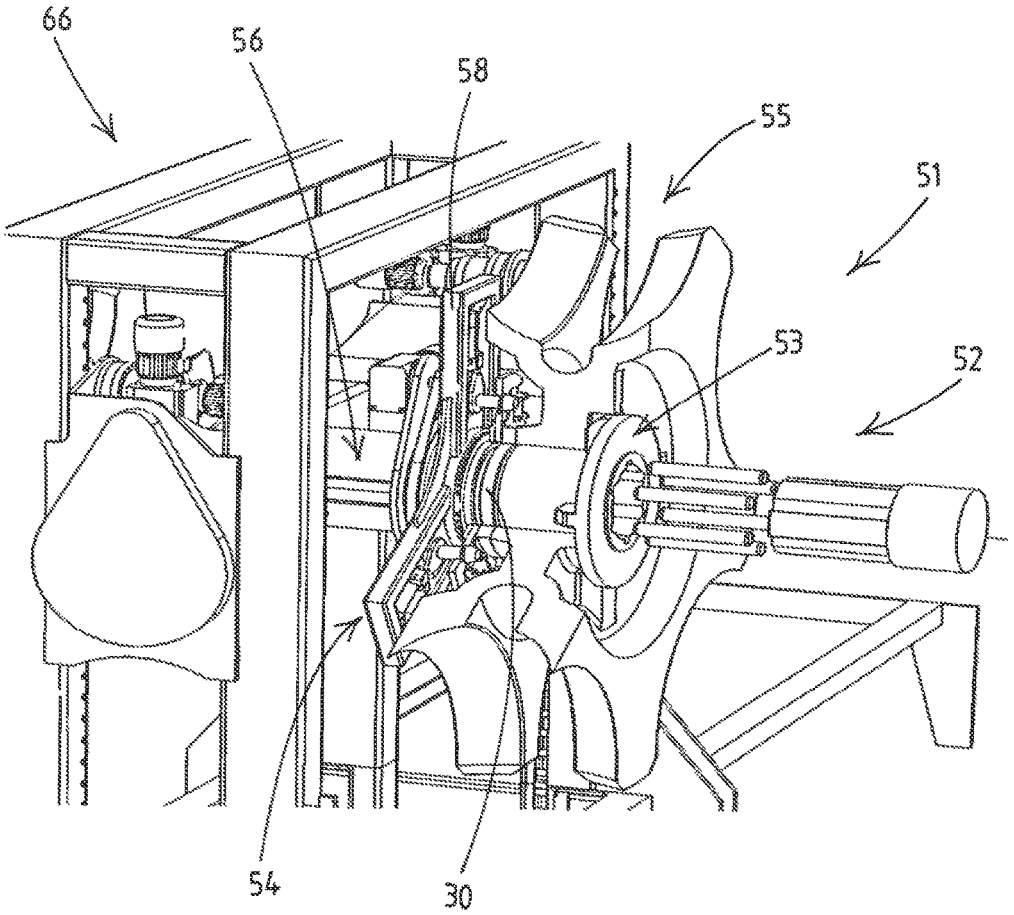
FIG. 7 shows, partially in cross section and partially in exploded view, part of a chain and cable handling winch system according to a first and a second aspect of the invention.
Figure 18:
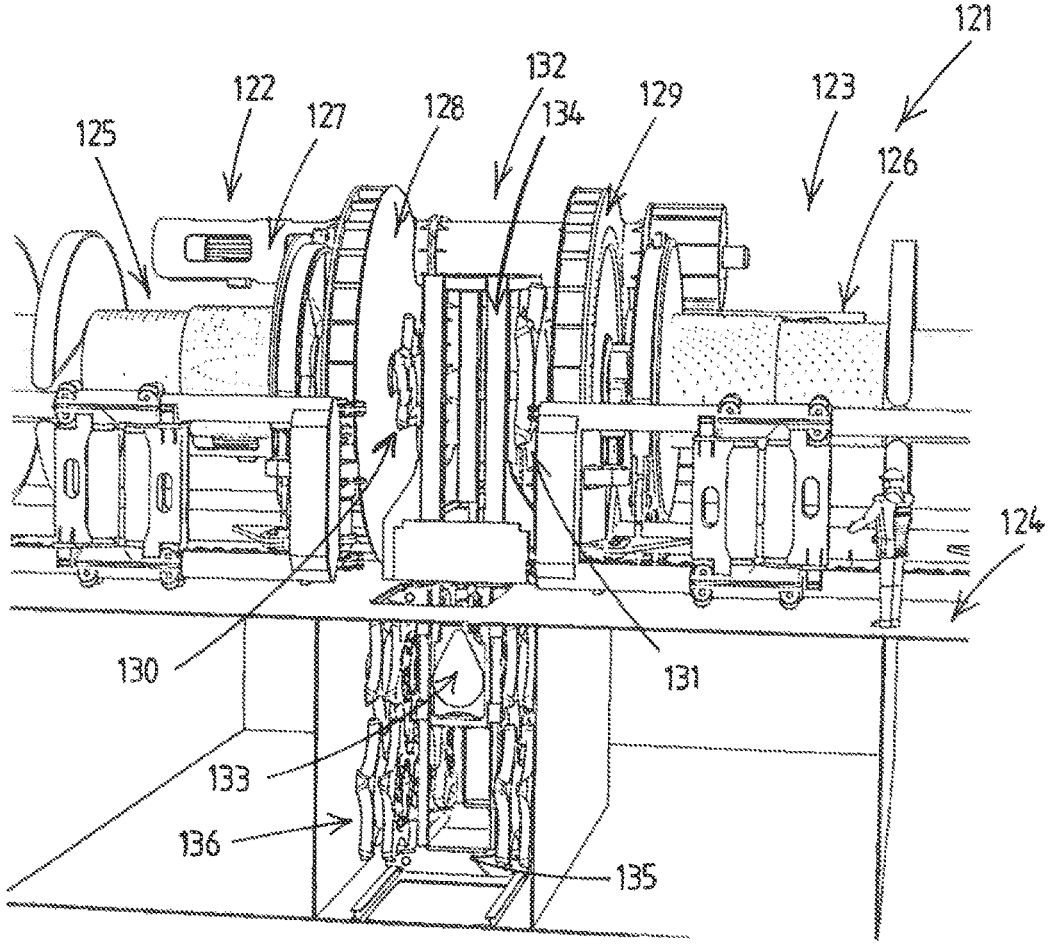
FIG. 18 shows a chain and cable handling winch system according to a second aspect of the invention.

FIG. 7 shows, partially in cross section, part of a chain and cable handling winch system 51 comprising a winch according to a second aspect of the invention. It is observed that the chain wheel and winch axle are essentially similar to the ones shown in FIGS. 4-6. FIG. 18 shows an overview of chain and cable handling winch system according to a second aspect of the invention.

A cable handling winch system according to a second aspect of the invention comprises a winch axle, a cable drum, a chain wheel, a frame, a motor drive, a chain wheel lock assembly and a chain wheel manipulator.

The cable drum is mounted on the winch axle, and the chain wheel is mounted in a working position on the winch axle at an end thereof. The frame rotatably supports the winch axle such that the axle is supported on opposite sides of the cable drum and inbetween the cable drum and the chain wheel. The motor drive is adapted to drive the winch axle. The chain wheel lock assembly is adapted to releasable secure the chain wheel in its working position on the winch axle end. The chain wheel lock assembly comprises one or more locking members movable between a locking position and an unlocking position.

The chain and cable handling winch system further comprises a chain wheel manipulator adapted to exchange chain wheels, which chain wheel manipulator, more in particular the chain wheel support thereof, can be positioned in a chain wheel exchange position adjacent to the end of the winch axle for mounting chain wheels onto the winch axle and dismounting chain wheels from the winch axle. The chain wheel manipulator comprises a chain wheel support for supporting a chain wheel, one or more grippers for engaging a chain wheel, and an actuator. The actuator is adapted for, when the chain wheel support is in its exchange position, moving the grippers and thus moving a chain wheel, in a direction substantially parallel to the winch axle between its working position on the winch axle and a transport position on the chain wheel support.

As noted, in FIG. 7 only part of a chain and cable handling winch system 51 according to the invention is shown. FIG. 7 shows part of the winch axle 52, more in particular an interface body 53 provided on the winch axle, with the chain wheel mounted thereon. FIG. 7 shows the assembly of interface body 53 and the winch axle end 52 in exploded view, such that the splines for mounting the interface body on the winch axle are also shown.

The Fig. furthermore shows a chain wheel manipulator 54 positioned with its chain wheel support in a chain wheel exchange position adjacent to the end of the winch axle 53.

Figure 8:
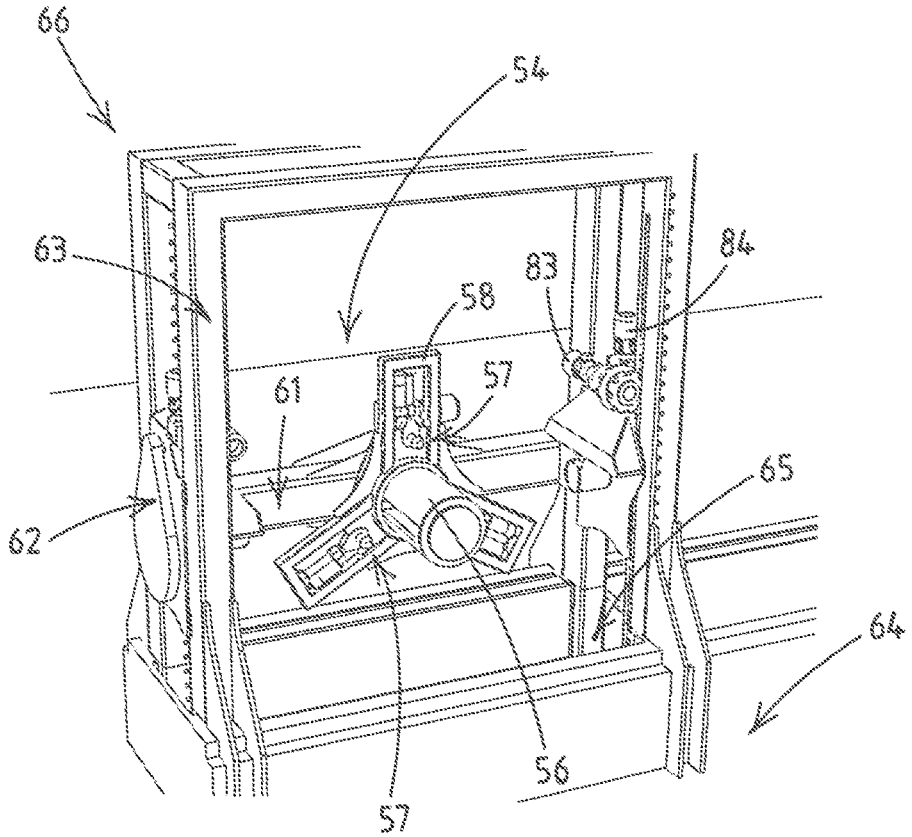
FIG. 8 shows an overview of the chain wheel manipulator of FIG. 7.

FIG. 8 shows an overview of the chain wheel manipulator 54. In FIG. 7 the chain wheel manipulator is coupled with the chain wheel mounted on the axle end. In FIG. 7 the chain wheel manipulator is able to support and transport a chain wheel, as will be explained in more detail below.

The chain wheel manipulator 54 comprises a chain wheel support 56, in the particular embodiment shown a cylindrical chain wheel support body adapted to receive a central opening of the chain wheel 55 for thus supporting the chain wheel. The cylindrical support body 55 has a diameter essentially similar to the diameter of the central opening of the chain wheel 55.

The chain wheel manipulator 54 furthermore comprises three grippers 57 for engaging a chain wheel. In the particular embodiment shown, the grippers 57 are slideably supported in a gripper support frame 58, such that they can be moved in the radial direction.

The gripper support frame 58 comprises a central body mounted on the chain wheel support, and three arms 59 extending in a radial direction that slideably support the grippers. The gripper support frame is slideably supported on the chain wheel support 56, such that it can slide along the chain wheel support 56. In FIG. 7 the gripper frame 58, and thus the grippers 57, are shown in the couple position, in which the grippers provided on the gripper frame can engage a chain wheel mounted on a winch axle end adjacent the chain wheel support 56. In FIG. 8 the gripper frame 58, and thus the grippers 57, are shown in the retain position, in which the grippers provided on the gripper frame can retain a chain wheel mounted on the chain wheel support 56.

In the embodiment shown the gripper frame 58 can also be rotated about the chain wheel support 56 to correctly position the grippers 57 for engaging a chain wheel.

In the particular embodiment shown, the chain wheel manipulator 54 is moveably supported by a chain wheel manipulator frame 66, as will be discussed in more detail further on. It is noted that a chain wheel manipulator according to the invention can also be me movably support in alternative ways, or example on a robot arm, by a crane, etc.

The three grippers 57 are movably mounted in the arms 58, such that they can be moved in a radial direction relative to the chain wheel support. Thus, the grippers are adapted to also function as locking means for moving the locking members between their locking position and a unlocking position, and thus to releasable secure the chain wheel in its working position on the winch axle end.

In the particular embodiment shown, spindles 59 are provided for moving grippers 55 in the radial direction. Other types of actuators can be used, for example hydraulic actuators.

The chain wheel manipulator 54 furthermore comprises an actuator for moving the grippers/locking means 57, more in particular the gripper support frame 58, in a direction substantially parallel to the winch axle. In the embodiment shown, the actuator is provided within the cylindrical chain wheel support 56, and is thus not visible in FIG. 8. In an alternative embodiment, the actuator for moving the gripper support frame is for example provided on the gripper support frame, or on the outside of the chain wheel support.

In the embodiment shown, the actuator is coupled with the gripper support frame 58 for moving the gripper support frame along the cylindrical chain wheel support 56. Thus, when the chain wheel manipulator is positioned with its chain wheel support in the chain wheel exchange position, and the grippers engage a chain wheel, the actuator can be used for moving that chain wheel between its working position on the winch axle and a transport position on the chain wheel support.

FIG. 8 shows a chain wheel manipulator 54 mounted in a chain wheel manipulator frame 66 the chain wheel manipulator frame comprising multiple sub frames. In the particular embodiment shown, the chain wheel manipulator 54 is supported by a carrier frame 61, that is pivotably mounted in a carriage frame 62, which in turn is moveably supported by a support frame 63. This aspect will be discussed in more detail with respect to FIGS. 14 and 15.

In FIGS. 7 and 8 the carriage frame 62, supporting the carrier frame 61 and the chain wheel manipulator 54, positioned in an above deck position. The carriage frame 62, and thus the carrier s frame 61, can be lowered though a deck opening 65 in the deck 64 and transferred to a chain wheel carrier transport frame, which is mounted below deck. The deck opening can preferably be closed using a hatch. This aspect of the will be discussed in more detail with respect to FIGS. 17 and 18.

It is noted that when the chain wheel manipulator 54 is positioned with its chain wheel support 56 in the chain wheel exchange position, as shown in FIG. 7, the chain wheel support body 56 is positioned parallel and in line with the winch axle onto which a chain wheel is to be mounted or from which the chain wheel has to be removed. The grippers are used to engage the chain wheel, and are subsequently translated parallel to the chain wheel support, and thus the winch axle, to slide the chain wheel from the chain wheel support onto the winch axle end or from the winch axle end onto the chain wheel support.

It is furthermore observed that in the particular embodiment shown, the gripper frame 58 is slideably mounted on the chain wheel support 56, and is pivotably mounted on the chain wheel support, such that it can be rotated about the longitudinal axis of the chain wheel support. By rotating the gripper support frame, the angular position of the gripper frame and grippers can be adjusted. Thus, when the chain wheel manipulator is positioned with its wheel support in a chain wheel exchange position, it can be rotated to adjust the position of the grippers to the angular position of the chain wheel prior to engaging it.

In an alternative embodiment, the chain wheel manipulator, including the chain wheel support, is rotatably mounted on the carrier frame, and the gripper support frame is only slideable along the chain wheel support. Other configurations are also possible.

Figure 9:
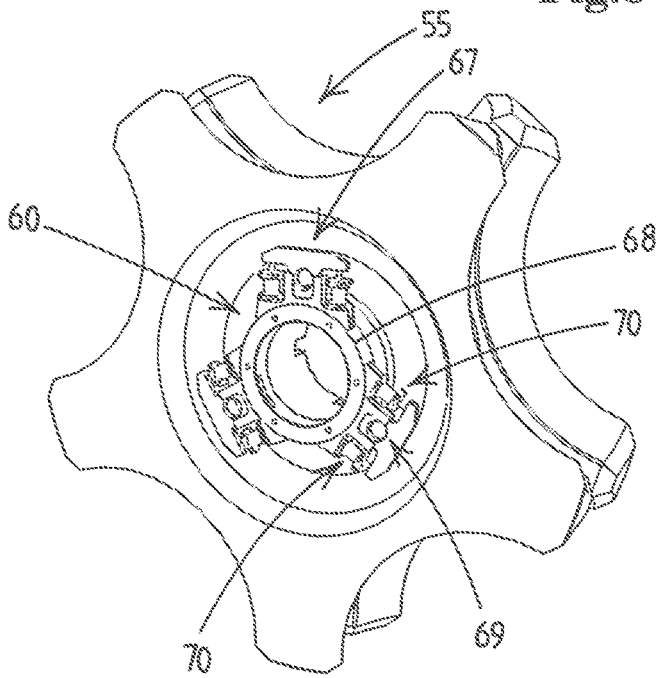
FIG. 9 shows a chain wheel and a chain wheel lock assembly of FIG. 7 in more detail.

FIG. 9 shows an overview of the chain wheel 55, which is provided with a chain wheel lock assembly 60. It is noted that the chain wheel 55 is essentially similar to the chain wheel 24 shown in FIGS. 4-6.

In the embodiment shown in FIG. 9, the chain wheel 55 is provided with a chain wheel lock assembly 60 adapted to releasable secure the chain wheel 55 in its working position on a winch axle end. The chain wheel lock assembly 60 is provided on the chain wheel 55. In an alternative embodiment, the chain wheel lock can be configured as a separate body.

The chain wheel lock assembly 60 in the embodiment shown is configured as a ring shaped body 68 provided with three locking members 67 for in a locking position securing the chain wheel 55 in its working position on a winch axle end, and in an unlocking position enabling the chain wheel to be moved from its working position.

The locking members 67 shown are movable in a radial direction between the locking position, as shown, and an unlocking position. In FIG. 9, the locking members are depicted in their radially inward locking position. In this position, an end of the locking members extends into the central opening of the chain wheel, as was also shown in FIGS. 5 and 6. In this position, the ends of the locking members can engage a groove, or other type openings, provided on a winch axle or chain wheel support.

In FIG. 9, it is clearly shown that the locking members 67 are provided with a circular opening 69 for receiving an unlocking means 57 of the chain wheel manipulator 54 shown in FIG. 8, for moving the locking member between their locking position and its unlocking position. It is noted that the locking members 67 shown are provided with resilient elements 70, in the particular embodiment shown spring elements, on both sides of the opening. The spring elements pull the latch shaped locking members radially inward, and thus towards their locking position.

In the particular embodiment shown in the Figs., the grippers 57 are configured to engage the chain wheel by engaging the locking members of the chain wheel lock assembly mounted on that chain wheel. Thus, the grippers can be used for both engaging the chain wheel and for unlocking and locking the chain wheel lock assembly. The grippers thus enable moving the chain wheel and locking the chain wheel in a position on an axle end.

To enable the grippers 57 to couple with the chain wheel, in the particular embodiment shown the grippers have a flanged head, providing the grippers with a mushroom like appearance. The locking members 67 are provided with opening 69 wide enough to receive the head of the grippers 57. When the grippers are subsequently moved in the radial direction to unlock the locking members, the flanged heads of the grippers hook behind locking members such that they cannot be retracted from the opening. Thus, the grippers can be used to pull the chain wheel from the winch axle end. When the grippers and the locking members are returned to their initial radial positions, the grippers are again free to be removed form the locking members.

The gripper frame is used to push the chain wheel from the chain wheel support onto the winch axle end. Furthermore, in the embodiment shown, the gripper frame 58 is positioned adjacent the chain wheel 55 when the grippers 57 are inserted into the openings 69 of the locking members 67, such that when the grippers are hooked behind the locking members, the chain wheel is locked inbetween the gripper frame and the grippers. Thus the chain wheel manipulator is provided with a secure grip on the chain wheel.

It is noted that other solutions are possible for coupling the grippers with the locking members to enable moving the chain wheel. For example, expandable gripping members can be provided the expand in an opening in the locking members to secure the grippers in the locking members, or for example L-shaped gripping members can be provided that are inserted through a slit shaped opening and subsequently rotated to hook them behind the locking member, or claw shaped grippers can be provided that engage a pin or grip provided on the locking members, etc.

It is noted that it is also possible to make the grippers engage the chain wheel directly, for example hook behind the circumference of the chain wheel or engage openings provided in the chain wheel, and provided additional grippers or separate keys for manipulating the locking members.

The exchange of a chain wheel of the winch axle is discussed in more detail below.

FIGS. 10-13 shows subsequent working positions of a chain and cable handling winch system according to the invention in subsequent working positions. The figs. show in cross section a chain wheel manipulator 71, a chain wheel 75 and a winch axle 74. The chain wheel manipulator is essentially similar to the one shown in FIG. 8.

The chain wheel manipulator 71 is provided with chain wheel support 80, on which is mounted a gripper support frame 88 supporting grippers 87. In the particular embodiment shown, the gripper support frame 88 comprises a slide 88*a* that is slideably mounted on the chain wheel support 80, and a wheel shaped frame part 88*b*, comprising arms 83, that is rotatably mounted on the slide 88*a*. The chain wheel support 80 is provided with longitudinal slots 81 for guiding the in gripper support frame 88.

An actuator 86 is provided for sliding the gripper support frame 83 along the chain wheel support 80. The actuator 86 is located inside the chain wheel support 80. The actuator 86 is coupled with the gripper support frame 83 via the slots 81 in the chain wheel support 80. An actuator 85 is provided to rotate the gripper support frame about the chain wheel support 80, more in particular to rotate the wheel shaped frame part 88*b* of the gripper support frame about the slide 88*b*. The actuator 85 is mounted on the slide 88*a* of the gripper support frame.

The grippers 87 are mounted in the arms 83 of the gripper support frame 88, similar to the gripper support frame shown in FIG. 8, such that they can move in a radial direction relative to the chain wheel support 80. The grippers 87 can be moved with actuators 82, which in the embodiment shown are provided in the arms in the form of spindles.

The chain wheel manipulator 71 is mounted on a carrier frame that is similar to the one shown in FIG. 8. The FIGS. 10-13 show an actuator 83 for moving the carrier frame in the vertical direction, and an actuator 84 for pivoting the carrier frame about a horizontal axle. In the embodiment shown, the actuator is a drive provided with a sprocket that engages a ratchet mounted in the frame. The actuators are provided on both ends of the carrier frame. Similar actuators have been indicated with the same reference signs in FIG. 8

Figure 11:
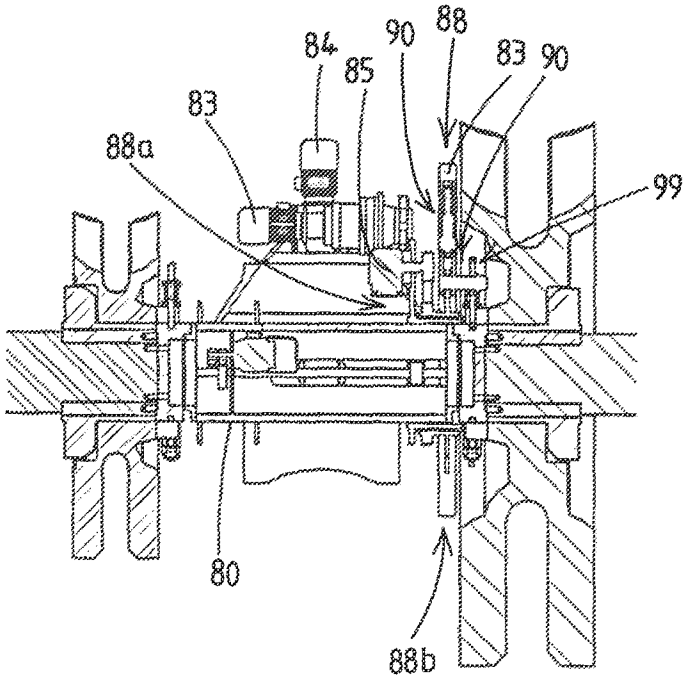
FIGS. 10-13 show, in cross section, a chain wheel and a chain wheel manipulator of a chain and cable handling winch system according to a second aspect of the invention, in subsequent working positions.

The chain wheel 75 is provided with a chain wheel lock assembly 90. The chain wheel 75 and the chain wheel lock assembly 90 are essentially similar to the chain wheel lock assembly 60 shown in FIG. 9. Of the chain wheel lock assembly 90, a locking member 97 is shown in cross section. The locking member 97 shown is essentially plate shaped, similar to the ones shown in FIG. 9. The locking members 97 are provided with resilient elements, not clearly shown in FIGS. 11-13, that pull the locking member in its locking position, which shown in FIG. 10. In this locking position, the locking members engage a circumferential groove 96 shaped opening in the adapter 79. The locking members comprise a circular opening 99 for receiving a gripper 87. FIG. 11 shows the gripper 87 inserted in the circular opening 99.

Figure 10:
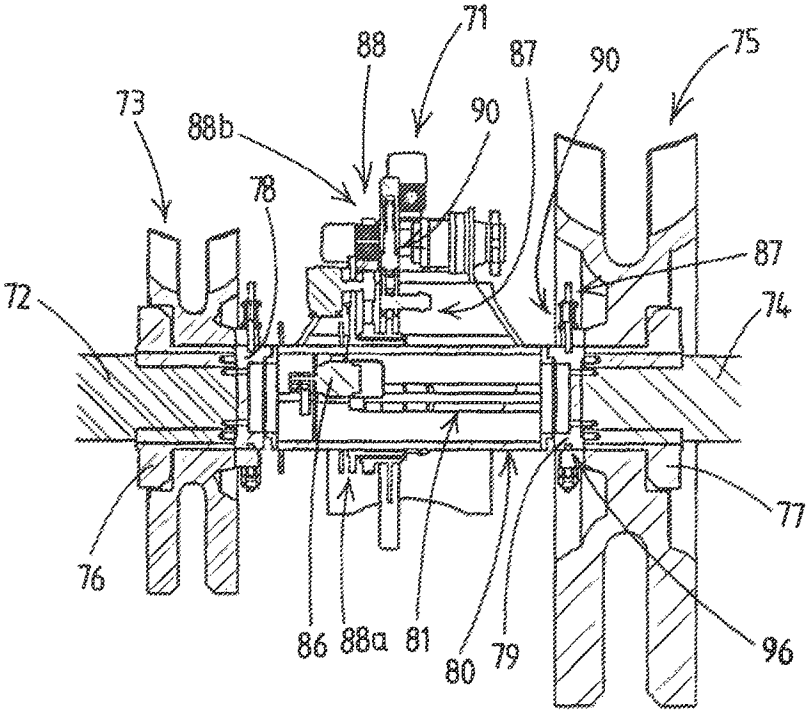

In FIG. 10, the chain wheel manipulator 71 is positioned with its chain wheel support 80 in a chain wheel exchange position. It is noted that in the particular embodiment shown in FIGS. 10-13 the chain wheel manipulator 71 is positioned inbetween a first winch axle end 72 supporting a chain wheel 73 and a second winch axle end 74 supporting a chain wheel 75. Both axle ends 72, 74 are provided with an interface body 76, 77 comprising an adapter 78, 79 provided with a C-shaped section for receiving the cylindrical shaped chain wheel support body 80 of a manipulator 71. The cylindrical chain wheel support body 80 is at both ends configured to engage the adapters. Thus, in the position shown, the chain wheel manipulator 71 engages both axle ends. Such a configuration provides additional stability.

In the configuration shown in FIG. 10, the chain wheel manipulator is able to exchange the chain wheel from the right winch axle. The chain wheel manipulator should be pivoted, which is possible by pivoting the carrier frame supporting the chain wheel manipulator, as will be explained in relation to FIGS. 16 and 17.

It is noted that the axle ends, respective interface bodies and chain wheels are essentially similar to the ones shown in FIGS. 4-7. It is noted though that the left chain wheel in FIG. 10 is smaller than the right chain wheel 75 shown in FIG. 10. This difference in size is however not relevant for explaining the invention.

In FIGS. 10-13, the chain wheel manipulator 71 is positioned with its chain wheel support 80 in a chain wheel exchange position for removing the right chain wheel 75 that is mounted in a working position on the axle end 74.

In the position show in FIG. 10, the chain wheel 75 is locked in its working position by the chain wheel lock assembly 90. The gripper support frame 88, and thus the grippers 87, are positioned in retain position at one end of the chain wheel support 80. In this position the grippers can retain a chain wheel on the chain wheel support. Also, the grippers 87 are located in their radially inward position. In this radially inward position they can engage locking members on the chain wheel that are in their locking position.

In the position shown in FIG. 11, the gripper support frame 88 is moved, by the actuator 86, from its retain position to a couple position at the opposite end of the chain wheel support. In this couple position the grippers 87 are positioned for engaging a chain wheel mounted on the winch axle 74 adjacent the chain wheel manipulator 71.

In the particular embodiment shown, the grippers 87 for engaging the chain wheel also function as keys to interlock with the locking members of the chain wheel lock assembly 90. The chain wheel manipulator comprises three of these gripper keys, one for each locking member. Of these gripper keys one is shown in cross section. The keys are adapted to engage the locking members 87 of the chain wheel lock assembly 90 and to move these locking members in a radial direction between their locking position and their unlocking position. In FIG. 11 the grippers have, after engaging the locking members, been moved in the radial direction and have thus moved the locking members in the radially outward unlock position. In the step shown in FIG. 11 the chain wheel 75 is thus no longer locked in its working position.

Furthermore, in the embodiment shown, the keys 90 and locking members 87 are configured such that the keys can only engage and disengage the locking members when in their locking position, and can not disengage the locking members when they have moved the locking members out of their locking position. Thus, by unlocking the locking members 87, the gripper keys interlock with the chain wheel 75, more in particular with the chain wheel lock assembly provided on the chain wheel. In the step shown in FIG. 11 the chain wheel 75 is thus no longer locked in its working position and is furthermore coupled with the chain wheel manipulator 71. The coupling of the chain wheel manipulator using the grippers has been explained with respect to FIGS. 8-9 already.

Figure 12:
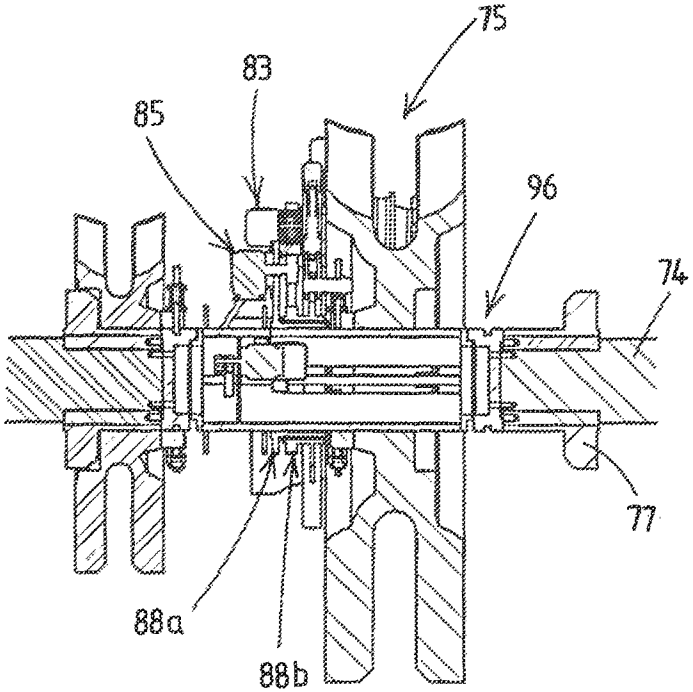

In the position shown in FIG. 12, the gripper support frame 88 is moved, by the actuator 86, from its couple position back into its retain position. By moving the gripper frame into its initial position, the chain wheel has been slid from the winch axle onto the chain wheel support. The grippers 87 now retain the chain wheel on the chain wheel support of the chain wheel manipulator 71. the chain wheel manipulator, more in particular the chain wheel support of the chain wheel manipulator, can now be moved out of its chain wheel exchange position, for example to move the chain wheel to a chain wheel storage, a work shop, another winch, etc. Since the chain wheel is retained by the gripper keys on the chain wheel support, there is no risk of the chain wheel sliding from the chain wheel support during transport.

Figure 13:
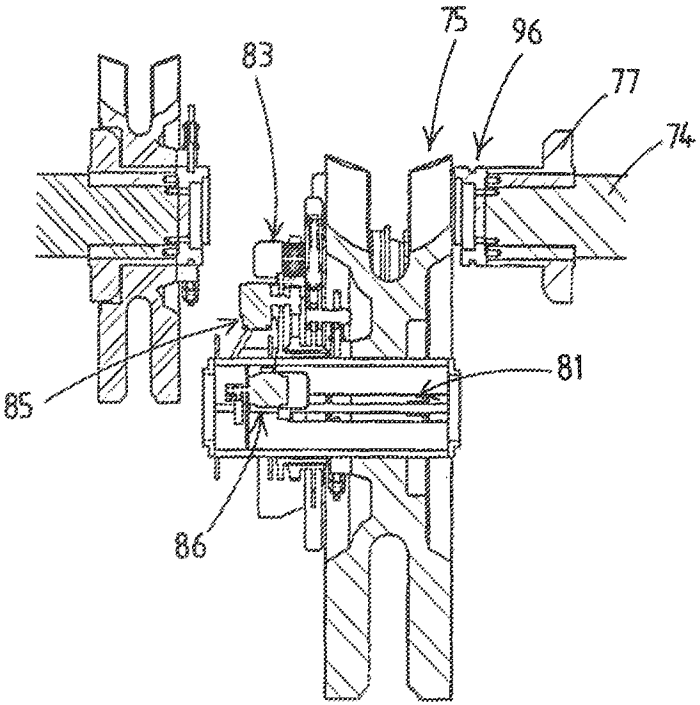

In the step shown in FIG. 13 the chain wheel support, and the chain wheel supported thereon, is moved out of the chain wheel exchange position. In the particular embodiment shown, the carrier frame supporting the chain wheel manipulator is lowered in a downward direction. The chain wheel can thus be transported towards a chain wheel storage located below deck.

It is observed that by reversing the order of steps shown in the FIGS. 10-13, a chain wheel can be mounted on a winch axle.

In the same way as described above, the chain wheel manipulator can be used to mount and dismount chain wheels in a storage position. In an embodiment, the chain wheel storage is provided with axle end similar to the ones of the winch axle, for mounting a chain wheel in a storage position in that chain wheel storage.

Figure 14:
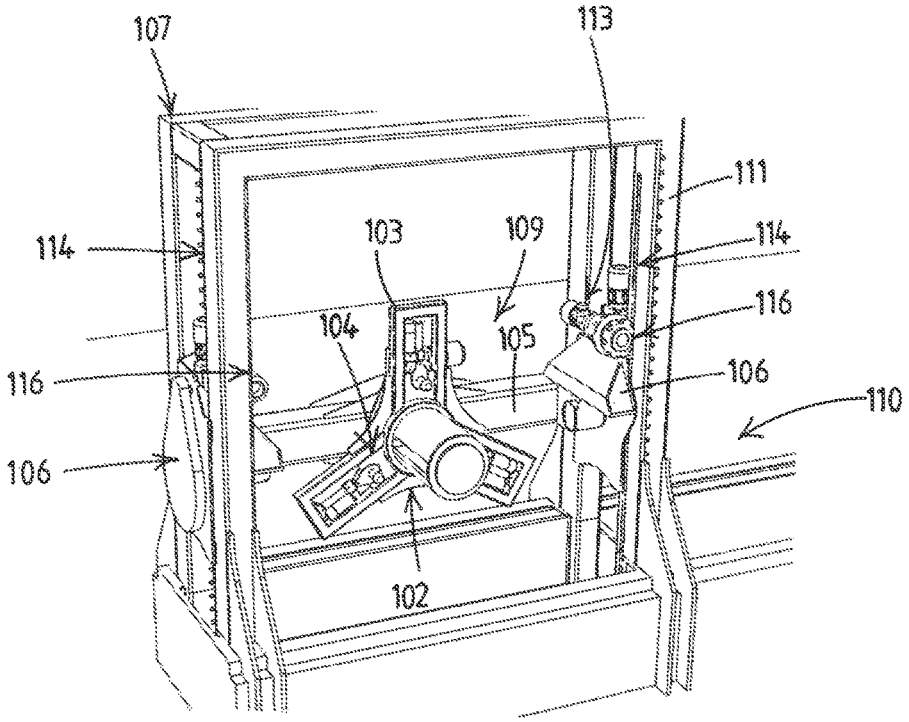
FIG. 14 shows a chain wheel manipulator according to a second aspect of the invention, mounted in a support frame and positioned in a chain wheel exchange position.

FIG. 14 shows a chain wheel manipulator 101 of a chain and cable handling winch system according to the invention, which manipulator is similar to the one depicted in FIGS. 7 and 8. The chain wheel manipulator 101 comprises a chain wheel support 102 and a gripper frame 103. The gripper frame 103 supports grippers 104 for engaging a chain wheel such that it can be moved by the chain wheel manipulator. The grippers 104 are furthermore adapted to function as keys to operate a chain wheel lock assembly, as has been explained above.

The chain wheel manipulator 101 is supported by a chain wheel manipulator frame, which chain wheel manipulator frame in the particular embodiment comprises a carrier frame 105, a carriage frame 106, a support frame 107 and a transport frame 108.

The chain wheel manipulator 101 is mounted on the carrier frame 105. In the embodiment shown the chain wheel support 102 is fixed to the carrier frame 105. The gripper frame 103 is mounted on the chain wheel support 102 such that it can slide along the chain wheel support between a couple position, for engaging and disengaging a chain wheel in a work position i.e. mounted on a winch axle, and a retain position, for retaining a chain wheel in a transport position i.e. mounted on the chain wheel support of the chain wheel manipulator.

In the embodiment shown, the carrier frame 105 is pivotably mounted in the carriage frame 106, which in turn is movably supported by support frame 107. The chain and cable handling winch shown further comprises transport frame 108, shown in FIG. 15, adapted to movably support the carriage frame.

The support frame 107 is mounted on a deck 110 of a vessel, in a fixed position. The support frame is mounted next to a chain and cable traction winch, not shown in the Fig., such that it can support the chain wheel manipulator 101, more in particular the chain wheel support 102 of the chain wheel manipulator, in a chain wheel exchange position next to said chain and cable handling winch.

The transport frame 108 is located below the deck 110. The transport frame 108 is movably supported by a transport track 109. In the particular embodiment shown, the transport track comprises rails for supporting the transport frame. In another embodiment, the transport frame is provided with for example wheels or skids or is movably supported on a transport track for guiding the carrier frame.

The transport frame 108 and the support frame 107 are adapted to movably support the carriage frame 106. In the particular embodiment shown, the two frames are provided with guides in the form of vertical frame sections 111, 112, for guiding the carriage frame. The carriage frame 106 is provided with actuators 113 in the form of electric motors driving cog wheels 116 that engage the frames, more in particular ratchet 114,115 provided on the frames of the respective support frame and the transport frame. Thus a rack/cog railway type of propulsion is provided for moving the carriage frame 106 in the vertical direction.

The transport frame 108 and the support frame 107 are configured such that the carriage frame 106 can be transferred between the two of them. In the particular embodiment shown, the support frame 107 is mounted above an opening 117 in the deck 110. The support frame 107 is open from below, and the transport frame 108 is open at the top. When the transport frame 108 is positioned below the opening 117 in the deck 110, the guides 111, 112 and ratchet tracks 114, 115 of the respective frames are positioned inline with each other. Thus, the carrier frame 116 can be moved between a below deck position, in which it is supported by the transport frame 108, and an above deck position, in which it is supported by the support frame 107.

In the embodiment shown, the chain and cable handling winch system comprises a chain wheel storage, shown in FIG. 15, below deck. The chain wheel manipulator 101, more in particular its chain wheel support, can be moved between at the chain wheel exchange position, shown in FIG. 14, and multiple chain wheel storage positions, of which one is shown in FIG. 15.

Figure 15:
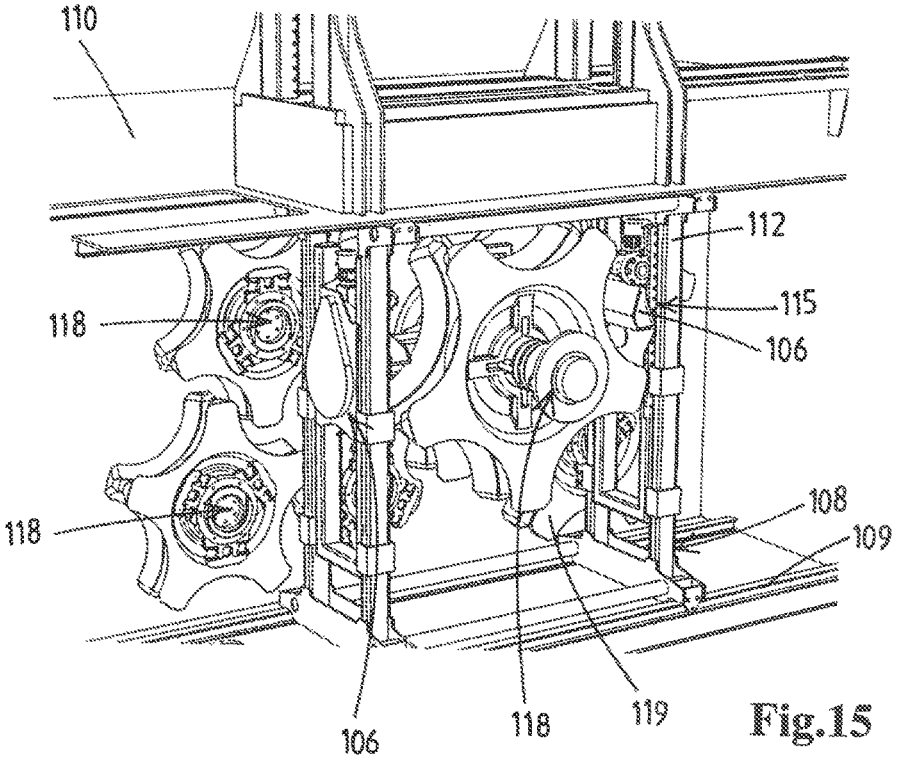
FIG. 15 shows the chain wheel manipulator of FIG. 14 mounted in a transport frame in a below deck chain wheel storage.

The particular chain wheel storage shown in FIG. 15 is provided with multiple axle ends 118 for each supporting a chain wheel in a storage position. By providing axle ends, the chain wheel lock assembly for securing a chain wheel in its working position on an axle end can be used for securing the chain wheel in its storage position also.

FIG. 15 shows multiple chain wheels mounted on axle ends located behind the transport frame. The fig. furthermore shows the chain wheel manipulator supporting a chain wheel 119 in a position for sliding the chain wheel on an axle end 118 mounted no a support frame on the front side of the transport frame. This transport frame is not shown in the Fig, not are additional axle ends supported by that frame to provide further storage positions.

The storage shown in FIG. 15 is thus provided with multiple storage supports, in the particular embodiment shown chain ends 118, for storing a chain wheel. The support frame 108 is mounted on a track 109 to move the chain wheel manipulator in a horizontal direction between the storage supports. By in addition moving the carriage frame in a vertical direction within the transport frame, the chain wheel manipulator can be positioned in front of the storage supports for storing and retrieving a chain wheel.

Figure 16:
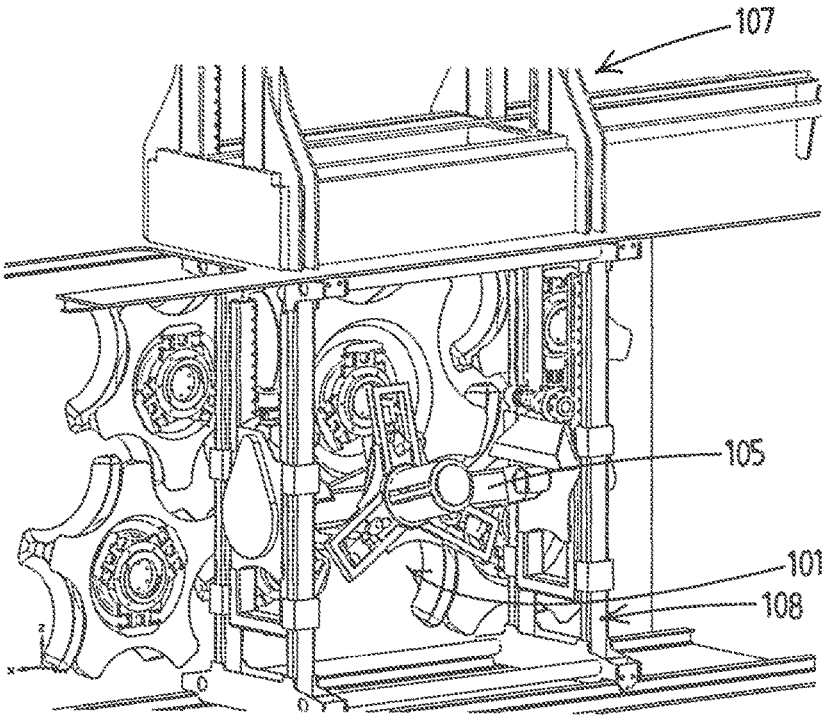
FIGS. 16 and 17 show the chain wheel manipulator of FIG. 15 being pivoted between two chain wheel exchange positions.
Figure 17:
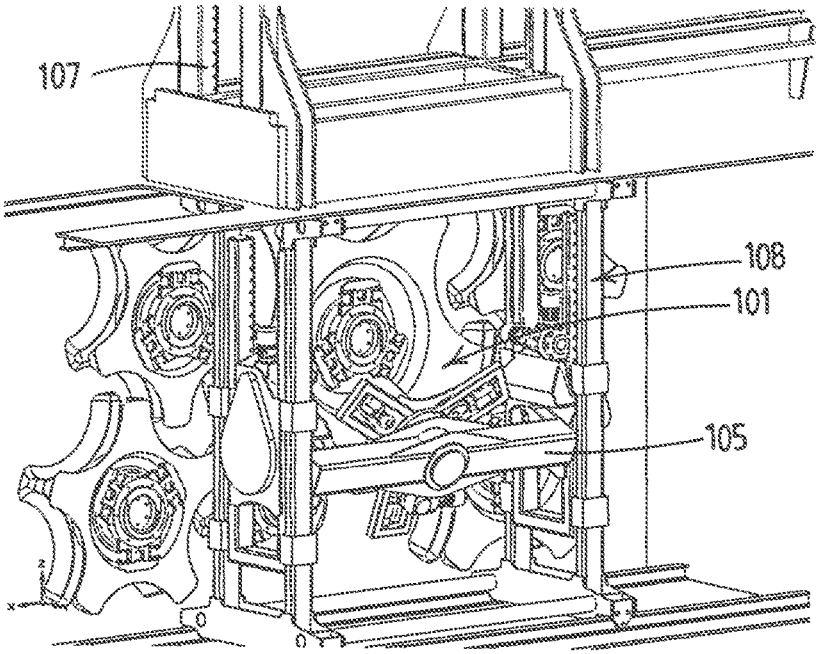

In the particular storage shown in FIG. 15, storage supports are provided on both sides of the transport track 109. The chain wheel manipulator 101, more in particular the carrier frame 105, is pivotably supported in the carriage frame 106 such that the chain wheel manipulator can be pivoted between a first position for mounting and dismounting a chain wheel at a first side of the transport frame 108 and a second position for mounting and dismounting a chain wheel at an opposite side of the transport frame 108. This aspect is shown in FIGS. 16 and 17, in which the chain wheel manipulator is shown while it pivots from a first exchange position at the front of the transport frame, FIG. 16, towards an exchange position at the back of the transport frame, shown in FIG. 17.

FIG. 18 shows a chain and cable handling winch system 121 according to the invention. The system comprises a first chain and cable handling winch 122 and second chain and cable handling winch 123.

Each winch is provided with a frame, a winch axle, a cable drum 125, 126, mounted on the winch axle, and a motor drive 127 adapted to drive the winch axles, more in particular to drive a wheel 128, 129 mounted on the respective winch axles.

The frame of the respective winches rotatably supports the winch axle such that the axle is supported on opposite sides of the cable drum by a first and second support, the first support being located inbetween the cable drum and the chain wheel end of the winch axle.

The winch axles each have a winch axle end adapted to mount a chain wheel thereon in a working position. In the configuration shown, the winches each removably support a chain wheel 130, 131. The two winches are positioned on a deck 124, such that the respective axle ends for mounting the chain wheels onto are directed towards each other, more in particular are substantially in line with each other.

The chain and cable winch system 121 further comprises a chain wheel manipulator supported in a chain wheel manipulator frame 132. The chain wheel manipulator frame is positioned inbetween the tow traction winches. The chain wheel manipulator frame comprises a carrier frame, a carriage frame 133, a support frame 134 and a transport frame 135, and is configured like the chain wheel manipulator frame shown in FIGS. 14 and 15.

The support frame 134 is positioned such that the carrier frame can pivot the chain wheel manipulator between a chain wheel exchange position on one side of the frame 134, for exchanging a chain wheel of the first winch 122, and a chain wheel exchange position on an opposite side of the frame, for exchanging a chain wheel of the second winch 123.

The chain and cable handling winch system further comprises a chain wheel storage 136, provided below deck, directly below the first and second winch.

The chain and cable handling winch system shown in FIG. 18 thus allows for exchanging the chain wheels mounted on the axle ends of the respective winches, and for storing chain wheels as well as the chain wheel manipulator in a below deck storage when not in use. In this storage the chain wheels and chain wheel manipulator are protected from the environment, for example rainstorms, etc. Thus, the chain wheel manipulator can be used for storing chain wheels in a storage, in addition to mounting and dismounting chain wheels from axle ends, more in particular winch axles.

In an alternative embodiment, the chain wheel manipulator is supported by a chain wheel manipulator frame less elaborate than the chain wheel manipulator frames shown in FIGS. 16-18. In an embodiment, the chain wheel manipulator is supported by a carrier frame that is provided with for example wheels or skids or is movably supported on a transport track for guiding the carrier frame, more in particular the chain wheel manipulator, between a deck based chain wheel exchange position and a deck based storage position.

In a further embodiment according to the invention, the chain wheel manipulator is supported on a chain wheel manipulator frame, for example a carrier frame, that is mounted on a crane, a robot arm, in a carousel or on for example a hydraulic cylinder, to enable moving the chain wheel manipulator. Thus, the chain wheel manipulator can be lifted and lowered, and can be moved between different chain wheel exchange positions and/or different storage positions.

In a further embodiment, the winch system further comprises one or more guide frames mounted above deck, for example supported by pillars or mounted to a roof structure, for supporting the chain wheel manipulator from above.

Supporting the chain wheel manipulator from above frees up deck space. In a further embodiment, the chain wheel storage is also provided above deck, for example with storage positions supported by a roof structure. In an embodiment, the chain wheel manipulator is provided with actuators, for example spindles or hydraulic cylinders, to manipulate the different components of the manipulator and/or to position the chain wheel manipulator, for example position the chain wheel support in a chain wheel exchange position adjacent the winch axle, with the chain wheel support in position for receiving a chain wheel from the winch axle.

In the embodiments shown to illustrate the second aspect of the invention, the chain wheel manipulator is provided with s gripper support frame having three arms that each slideably support a gripper. It is noted that other configurations of frame and gripper are also possible. For example, two grippers can be provided, or three or more. The gripper frame can be provided with arms to support the grippers, or with just a single body for supporting the grippers.

Furthermore, grippers can be provided that engage openings in the chain wheel or locking members provided thereon, that engage the contour of the chain wheel, coupling means provided on the chain wheel, etc. The grippers can be supported such that they can slide, pivot, hinge and/or rotate to engage the chain wheel. The grippers can also be provided with coupling means such as claws or electro magnets for engaging the chain wheel.

In the embodiments shown, the chain wheel support is a cylindrical shaped body having an outside circumference similar to the outside circumference of the winch axle. It is noted that the chain wheel support can be provided in other configurations as well. For example, in an embodiment the chain wheel support is provided in the form of three or more parallel pins, and the chain wheel is provided with three or more corresponding openings for receiving the respective pins. The pins extend parallel to the winch axle when the chain wheel manipulator is in a chain wheel exchange position, and are than located directly adjacent the openings in the chain wheel. Thus the chain wheel can be slid from the chain wheel axle onto these pins, the three opening of the chain wheel engaging the pins while the central opening is moved from the winch axle.

In the embodiments shown, the grippers are used for retaining the chain wheel when in the transport position on the chain wheel support. In an alternative embodiment, separate retaining elements are provided. For example, the chain wheel body can near its end be provided with retractable blocking pins. While the chain wheel is moved onto the chain wheel support, the pins are retracted in the chain wheel support. When the chain wheel is positioned in the transport position on the chain wheel support, the pins are extended in a radially outward direction from opening in the chain wheel support such that the pins block movement of the chain wheel towards the end of the chain wheel support.

In an embodiment the chain wheel manipulator is provided with a control device, for example provided in a control room, for manipulating the chain wheel manipulator, more in particular move the chain wheel manipulator, more in particular its chain wheel support, between chain wheel exchange positions and for example storage positions, and/or move the chain wheel manipulator along a transport track.

In a further embodiment, the chain wheel manipulator is provided with control means for semi or fully automatically controlling movement of the chain wheel manipulator or parts thereof. Also, imaging devices, distance sensors, scanning devices, etc can be provided to provide the control system with additional information about the status and position of the chain wheel manipulator and/or a chain wheel provided thereon.

It is observed that the invention, i.e. the first and/or second aspect of the invention, is illustrated with the same type of winch. The winches shown in the Figs. have a single winch axle that is rotatably supported by the winch frame. Of the winch axle, one end is adapted to mount a chain wheel thereon in a working position. Furthermore, the winches are each provided with a single cable drum that is mounted on the winch axle, more in particular fixed to the winch axle such that both rotate as a single body. Thus, the cable drum can be rotated by one or more motor drives engaging the cable winch axle directly, or engaging a wheel mounted on the winch axle.

Other types of winches can be used in with a chain and cable handling winch system according to the invention. For example a winch comprising more than one cable drum, for example a double drum traction winch a mooring line deployment winch, or a winch having a winch axle that is at both ends adapted for supporting a chain wheel. Also, different configurations for supporting the cable drum and the chain wheel are possible. For example, the cable drum can be rotatably mounted on the winch axle.

A chain wheel manipulator according to the invention can in principle also be used for exchanging other bodies removably mounted on an axle end, for example a pulley, in particular when that body is provided with a chain wheel lock assembly according to the invention. The chain wheel lock assembly according to the invention provides a quick locking and unlocking system, and can in principle be used for bodies on an axle end that are not chain wheels, for example pulleys.

The invention, i.e. the first aspect of the invention as well as the second aspect of the invention or a combination of both, is in particular aimed at use for heavy duty winch systems, in particular winch systems used on off shore platforms, vessels and the like. Chain wheel used with these kinds of winches may way up to 10 tonne or more and are thus difficult to handle.

Chain wheels used with these winches typically comprise a chain wheel body with a central opening adapted to engage the chain wheel end of the winch axle.

It is observed that when the chain wheel is positioned in its working position, it is mounted on a winch axle and coupled with that winch axle, either directly or indirectly, such that a torque load can be transferred from the chain wheel to the winch axle and visa versa, preferably via an interface body mounted on the winch axle.

The chain and cable handling winch system is preferably configured such that it can transfer a torque load larger than 1500 KNm, preferably in the range of 2000-3250 KNm, which are torque loads typically encountered with winch systems used on drilling vessels and drilling off shore platforms and the like.

The invention claimed is:

1. A chain and cable handling winch system comprising:

a winch, the winch having:

a winch axle, the winch axle having a winch axle end adapted to mount a chain wheel thereon in a working position;

a cable drum mounted on the winch axle;

a frame, supporting the winch axle such that the winch axle is supported on opposite sides of the cable drum by a first and second support, the first support being located inbetween the cable drum and the winch axle end of the winch axle; and a motor drive adapted to drive the winch;

the chain wheel, the chain wheel having:

a chain wheel body with a central opening adapted to engage the winch axle end of the winch axle, the chain wheel being in a working position when mounted on the winch axle end of the winch axle;

a chain wheel lock assembly, wherein the assembly is adapted to releasably secure the chain wheel in the working position on the winch axle end of the winch axle, the chain wheel lock assembly comprising one or more locking members movable between a locking position and an unlocking position; and an interface body, mounted on the winch axle end of the winch axle such that the interface body rotates with the winch axle, wherein the interface body is provided with slots and/or ribs and the chain wheel is provided with corresponding ribs and/or slots, the slots and/or ribs of the interface body being adapted to cooperate with the corresponding ribs and/or slots of the chain wheel such that:

when the chain wheel is mounted in the working position on the winch axle end of the winch axle, the slots and/or ribs of the chain wheel interlock with the corresponding ribs and/or slots of the interface body, such that, when the chain wheel is subjected to a tangential force generating a torque load about the winch axle, the torque load is transferred from the chain wheel to the winch axle via the interface body and visa versa; and when the chain wheel is moved out of the working position in a direction substantially parallel to the winch axle, the slots and/or ribs and the chain wheel unlock with the corresponding ribs and/or slots of the interface body.

2. The winch system according to claim 1, wherein the ribs and/or slots are provided with contact surfaces that transfer the torque load between the chain wheel and the interface body, the contact surfaces extending in a substantially radial direction and substantially parallel to the winch axle, such that the contact surfaces extend essentially perpendicular to a tangential force generating the torque load about the winch axle for the torque load to be transferred between the chain wheel and the interface body.

3. The winch system according to claim 1, wherein the interface body has a cylindrical section that extends along the winch axle, and the chain wheel in the working position is mounted on an outside surface of the cylindrical section of the interface body.

4. The winch system according to claim 3, wherein the cross section of the cylindrical section of the interface body has an outside contour complementary to the inside contour of the central opening of the chain wheel.

5. The winch system according to claim 3, wherein the interface body is provided with a flange, the flange forming a stop for positioning the chain wheel in the working position such that when the chain wheel is locked in the working position, the chain wheel is positioned inbetween the flange and the chain wheel lock assembly.

6. The winch system according to claim 5, wherein the slots and/or ribs of the interface body are provided on the flange, and extend in an essentially radial direction, and the corresponding ribs and/or slots of the chain wheel are provided on a side of the chain wheel, such that they interlock when the chain wheel is mounted in the working position.

7. The winch system according to claim 1, wherein the interface body is coupled with the winch axle end via splines in the form of cylindrical pins inserted in longitudinal grooves provided in the outside surface of the winch axle and corresponding longitudinal grooves provided in an inside surface of a bore of the interface body.

8. The winch system according to claim 1, wherein the one or more locking members of the chain wheel lock assembly can be moved between a radially inward locking position and a radially outward unlocking position, and wherein the interface body and/or the winch axle are/is provided with one or more openings, the one or more openings facing radially outward, for receiving part of the locking members when in their radially inward locking position.

9. The winch system according to claim 1, wherein the one or more locking members of the chain wheel lock assembly are located on one side of the chain wheel, and the slots and/or ribs of the chain wheel for cooperating with the corresponding ribs and/or slots of the interface body are provided on an opposite side of the chain wheel.

10. The winch system according to claim 9, wherein the chain wheel lock assembly is part of the chain wheel body.

11. The winch system according to claim 1, wherein the chain wheel lock assembly is an essentially ring shaped body provided with locking members movable in a radial direction between a radial inward locking position and a radial outward unlocking position.

12. The winch system according to claim 1, wherein one or more resilient elements are provided that force the locking members towards their locking position.

13. The winch system according to claim 1, wherein the interface body further comprises an adapter mounted on an end face of the winch axle and positioning the interface body in position on the winch axle end of the winch axle.

14. The winch system according to claim 13, wherein the adapter is provided with one or more openings for receiving the locking members when in their locking position to secure the chain wheel lock assembly on the winch axle.

15. The winch system according to claim 13, wherein the adapter is configured to receive a manipulator for mounting a chain wheel on the winch axle end of the winch axle and for dismounting a chain wheel from the winch axle end of the winch axle, and position the manipulator relative to the interface body.

* * * * *